US011174070B2

(12) United States Patent
Kalinowski et al.

(10) Patent No.: US 11,174,070 B2
(45) Date of Patent: Nov. 16, 2021

(54) STACKABLE PALLET

(71) Applicant: Rehrig Pacific Company, Los Angeles, CA (US)

(72) Inventors: Dane Gin Mun Kalinowski, Foothill Ranch, CA (US); Way Joe Lee, Marietta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 16/987,614

(22) Filed: Aug. 7, 2020

(65) Prior Publication Data

US 2021/0039830 A1 Feb. 11, 2021

Related U.S. Application Data

(60) Provisional application No. 62/884,000, filed on Aug. 7, 2019.

(51) Int. Cl.
*B65D 19/00* (2006.01)

(52) U.S. Cl.
CPC .. *B65D 19/004* (2013.01); *B65D 2519/00034* (2013.01); *B65D 2519/00069* (2013.01); *B65D 2519/0096* (2013.01); *B65D 2519/00288* (2013.01); *B65D 2519/00318* (2013.01); *B65D 2519/00338* (2013.01)

(58) Field of Classification Search
CPC .. B65D 2519/00935; B65D 2519/0094; B65D 2519/0097; B65D 2519/00955
USPC ..... 108/53.1, 53.3, 53.5
See application file for complete search history.

(56) References Cited

U.S. PATENT DOCUMENTS

| | | | |
|---|---|---|---|
| 2,544,657 | A | 3/1951 | Cushman |
| 2,916,239 | A | 12/1959 | Leslie |
| 3,424,110 | A | 1/1969 | Toot |
| 3,526,195 | A | 9/1970 | Maryonovich |
| 3,640,229 | A | 2/1972 | Bell |
| 3,685,461 | A | 8/1972 | Belcher |
| 3,685,463 | A | 8/1972 | Francis |
| D225,397 | S | 12/1972 | Lindley |
| 3,709,162 | A | 1/1973 | Roper |

(Continued)

FOREIGN PATENT DOCUMENTS

| | | | | |
|---|---|---|---|---|
| CA | 2958971 | A1 * | 8/2017 | ..... B65D 19/38 |
| DE | 2232200 | A1 | 1/1973 | |

(Continued)

*Primary Examiner* — Jose V Chen
(74) *Attorney, Agent, or Firm* — Carlson, Gaskey & Olds, P.C.

(57) ABSTRACT

A first pallet includes a deck and a peripheral wall extending downward from a periphery of the deck. A plurality of feet extend downward from the deck. Each of the feet includes a foot wall defining its periphery. An outer portion of each foot wall is coterminous with the peripheral wall of the deck. The deck includes an opening aligned with each of the plurality of feet. A second, wider pallet may be used with the first pallet. The second pallet may be stacked on the first pallet and vice versa. In the second pallet, the outer portion of the wall of each of the feet is spaced inward from the peripheral wall of the deck, such that the deck of the second pallet is wider than the deck of the first pallet, but the spacing and size of the feet of both decks are identical.

24 Claims, 22 Drawing Sheets

(56) References Cited

U.S. PATENT DOCUMENTS 3,993,168 A * 11/1976 Kubick ..... B65D 19/0034 108/53.1
4,013,021 A 3/1977 Steinlein et al.
4,133,270 A 1/1979 Ravera
D258,948 S 4/1981 Stump, Jr.
4,263,855 A 4/1981 Lawlor
4,428,306 A 1/1984 Dresen et al.
4,879,956 A 11/1989 Shuert
5,046,434 A 9/1991 Breezer et al.
5,088,418 A 2/1992 Reckermann et al.
5,117,762 A 6/1992 Shuert
5,168,817 A 12/1992 Nulle et al.
5,341,748 A * 8/1994 Liu ..... B65D 19/0018 108/53.3
5,527,585 A 6/1996 Needham et al.
5,566,624 A 10/1996 Brown et al.
5,606,921 A 3/1997 Elder et al.
5,615,608 A 4/1997 Shaw et al.
5,638,760 A 6/1997 Jordan et al.
5,664,934 A 9/1997 Schaede et al.
D388,931 S 1/1998 Constantino et al.
5,755,162 A 5/1998 Knight et al.
5,769,001 A 6/1998 Viessmann
5,769,003 A 6/1998 Rose et al.
5,791,262 A 8/1998 Knight et al.
5,809,905 A 9/1998 John et al.
5,813,355 A 9/1998 Brown et al.
D400,681 S 11/1998 Sadr
D400,682 S 11/1998 Constantino et al.
5,857,416 A 1/1999 Donnell, Jr. et al.
5,950,545 A 9/1999 Shuert
5,964,162 A 10/1999 Chuan-Jen
5,996,508 A 12/1999 Constantino et al.
6,123,032 A 9/2000 Ohanesian
6,209,464 B1 * 4/2001 Elder ..... B65D 19/004 108/53.3
6,289,823 B1 9/2001 Koefelda et al.
6,294,114 B1 9/2001 Muirhead
6,327,984 B1 12/2001 McCann et al.
6,718,888 B2 4/2004 Muirhead
D513,104 S 12/2005 Harding et al.
6,997,113 B1 * 2/2006 Harding ..... B65D 19/0028 108/53.1
7,114,906 B1 10/2006 Baumgarner et al.
D548,924 S 8/2007 Frankenberg
7,293,509 B2 11/2007 Hassell
7,360,493 B2 4/2008 Hummel et al.
7,690,315 B2 4/2010 Apps
7,735,429 B2 6/2010 Meissen
7,735,430 B2 6/2010 Muirhead
7,819,068 B2 10/2010 Apps et al.
7,856,932 B2 12/2010 Stahl et al.
7,874,256 B2 1/2011 Muirhead
7,987,797 B2 8/2011 Stahl et al.
7,988,405 B2 8/2011 Ellington
8,011,677 B1 9/2011 Ellington et al.
8,075,244 B2 12/2011 Ellington
8,191,486 B2 6/2012 Apps et al.
8,196,527 B2 6/2012 Linares
8,210,107 B2 7/2012 Muirhead
8,230,793 B2 7/2012 Apps
8,282,111 B2 10/2012 Hailston et al.
8,291,839 B2 * 10/2012 Apps ..... B65D 19/004 108/57.25
8,360,443 B2 1/2013 Ellington
8,448,583 B2 5/2013 Apps et al.
8,776,697 B1 7/2014 O'Connell
8,894,076 B2 11/2014 Hailston et al.
8,950,759 B2 2/2015 Thorsen et al.
D724,809 S 3/2015 Howland et al.
8,967,056 B2 3/2015 Apps et al.
D729,488 S 5/2015 Pulskamp et al.
9,027,487 B1 5/2015 O'Connell
9,120,596 B2 9/2015 Dunn
9,169,040 B2 10/2015 Evans et al.
9,221,580 B2 12/2015 Zelek et al.
9,242,760 B2 1/2016 Nevo
9,260,125 B2 2/2016 Ellington et al.
D753,392 S 4/2016 Haas et al.
D756,645 S 5/2016 Haas et al.
9,387,953 B2 7/2016 Takyar et al.
9,403,547 B2 8/2016 Ellington
9,481,488 B2 11/2016 Lewis
9,611,071 B2 4/2017 Baltz et al.
10,232,979 B2 3/2019 Takyar et al.
10,479,553 B2 11/2019 Guerry et al.
10,479,661 B2 11/2019 King et al.
10,494,140 B2 12/2019 Shuert
10,494,141 B2 12/2019 Wood et al.
10,538,360 B2 1/2020 Thompson
2001/0029874 A1 10/2001 Muirhead
2002/0017225 A1 2/2002 Koefelda et al.
2003/0209171 A1 11/2003 Milles
2004/0134390 A1 7/2004 Apps et al.
2004/0168618 A1 9/2004 Muirhead
2005/0211139 A1 9/2005 Perrotta et al.
2005/0263043 A1 * 12/2005 Proudlove ..... B65D 19/0018 108/56.3
2006/0032411 A1 2/2006 Hummel et al.
2006/0162624 A1 7/2006 Hassell
2006/0254476 A1 11/2006 MacDonald et al.
2007/0131148 A1 6/2007 Wu
2007/0181045 A1 * 8/2007 Smyers ..... B65D 19/0028 108/53.3
2007/0210542 A1 9/2007 Hammond
2007/0272640 A1 * 11/2007 Garcia ..... A47B 87/0215 211/187
2008/0060561 A1 3/2008 Carrasco
2008/0295748 A1 12/2008 Yoshida et al.
2009/0050030 A1 2/2009 Apps et al.
2009/0183953 A1 7/2009 Ellington
2009/0185890 A1 7/2009 Ellington
2010/0043678 A1 2/2010 Linares
2010/0095875 A1 4/2010 Hailston et al.
2010/0154685 A1 6/2010 Arinstein
2010/0196134 A1 8/2010 Stahl et al.
2010/0295261 A1 11/2010 Ellington
2010/0326334 A1 12/2010 Lin
2011/0100268 A1 5/2011 Milkowski et al.
2011/0139040 A1 6/2011 Apps et al.
2011/0171000 A1 7/2011 Hailston
2011/0179978 A1 7/2011 Schmitt
2011/0187022 A1 8/2011 Muirhead
2012/0048154 A1 3/2012 Toomer et al.
2012/0291678 A1 11/2012 Howland et al.
2012/0298014 A1 * 11/2012 Wilson ..... B65D 19/0016 108/53.1
2012/0319063 A1 12/2012 Hailston et al.
2013/0133557 A1 5/2013 Yoshinaga
2013/0202400 A1 8/2013 Richard et al.
2013/0223962 A1 8/2013 Ellington et al.
2014/0000493 A1 1/2014 Apps et al.
2014/0283713 A1 9/2014 Baltz et al.
2015/0108037 A1 4/2015 Evans et al.
2015/0135999 A1 5/2015 Takyar et al.
2015/0225215 A1 8/2015 King et al.
2015/0274359 A1 * 10/2015 Linares ..... B65D 19/38 108/53.1
2016/0167831 A1 6/2016 Suiter et al.
2016/0318656 A1 11/2016 Takyar et al.
2016/0318657 A1 11/2016 Takyar et al.
2017/0240194 A1 8/2017 Kalinowski et al.
2017/0341667 A1 11/2017 Kalinowski et al.
2018/0029623 A1 2/2018 Kalinowski et al.
2018/0162434 A1 7/2018 Kalinowski et al.
2019/0185205 A1 * 6/2019 Jurcak ..... B65D 19/38
2019/0337673 A1 11/2019 O'Connell
2020/0102197 A1 * 4/2020 King ..... B65D 19/0018
2020/0148417 A1 * 5/2020 Daubenspeck ..... B65D 19/38

(56) References Cited

U.S. PATENT DOCUMENTS

FOREIGN PATENT DOCUMENTS

| | | | | |
|---|---|---|---|---|
| DE | 2613083 | A1 | 10/1977 | |
| DE | 2733457 | | 2/1979 | |
| DE | 3806097 | | 9/1989 | |
| DE | 202015104613 | U1 * | 9/2015 | ..... B65D 19/0018 |
| EP | 202203 | | 11/1986 | |
| EP | 849184 | | 6/1998 | |
| EP | 2028117 | | 2/2009 | |
| EP | 2394922 | A1 * | 12/2011 | ..... B65D 19/004 |
| EP | 2487117 | A1 * | 8/2012 | ..... B65D 19/004 |
| EP | 2724956 | | 4/2014 | |
| FR | 1449377 | | 8/1966 | |
| FR | 2206248 | | 6/1974 | |
| FR | 2259023 | | 8/1975 | |
| FR | 2274512 | | 1/1976 | |
| FR | 2486029 | | 1/1982 | |
| GB | 859186 | | 1/1961 | |
| GB | 901340 | | 7/1962 | |
| HU | 9303243 | | 3/1994 | |
| HU | 9900326 | | 5/1999 | |
| JP | 53058581 | | 5/1978 | |
| JP | 04114859 | | 4/1994 | |
| JP | 06179448 | | 6/1994 | |
| JP | 06191536 | | 7/1994 | |
| WO | WO9411262 | | 5/1994 | |
| WO | WO2004063035 | | 7/2004 | |
| WO | WO2005068309 | | 7/2005 | |

* cited by examiner

STACKABLE PALLET

BACKGROUND

Pallets generally include a deck having an upper support surface for supporting goods above a floor. A plurality of feet extend downward from the deck to provide tine openings between the feet and below the deck.

Half-pallets, typically in the range of approximately 20-24 inches by approximately 40-48 inches, may be used to provide deliveries into stores. Sometimes narrower pallets would be advantageous in certain delivery locations with tighter spaces, while sometimes wider pallets would be required for certain products.

SUMMARY

A first pallet includes a deck including an upper support surface and a peripheral wall extending downward from a periphery of the upper support surface. A plurality of feet extend downward from the deck. Each of the feet include a foot wall defining a periphery of the foot. An outer portion of each foot wall is coterminous with the peripheral wall of the deck. The deck includes an opening aligned with each of the plurality of feet. The foot wall protrudes inwardly of the respective opening to form a ledge recessed downward from the upper support surface of the deck.

A second, wider pallet may be used with the first pallet. The second pallet may be stacked on the first pallet. The second pallet has a plurality of feet extending downward from a deck having a peripheral wall. The outer portion of the wall of each of the feet is spaced inward from the peripheral wall of the deck, such that the deck of the second pallet is wider than the deck of the first pallet, but the spacing and size of the feet of both decks are identical. In this manner, a system with two different-width pallets can be used together and stacked together when empty.

DETAILED DESCRIPTION

Figure 1:
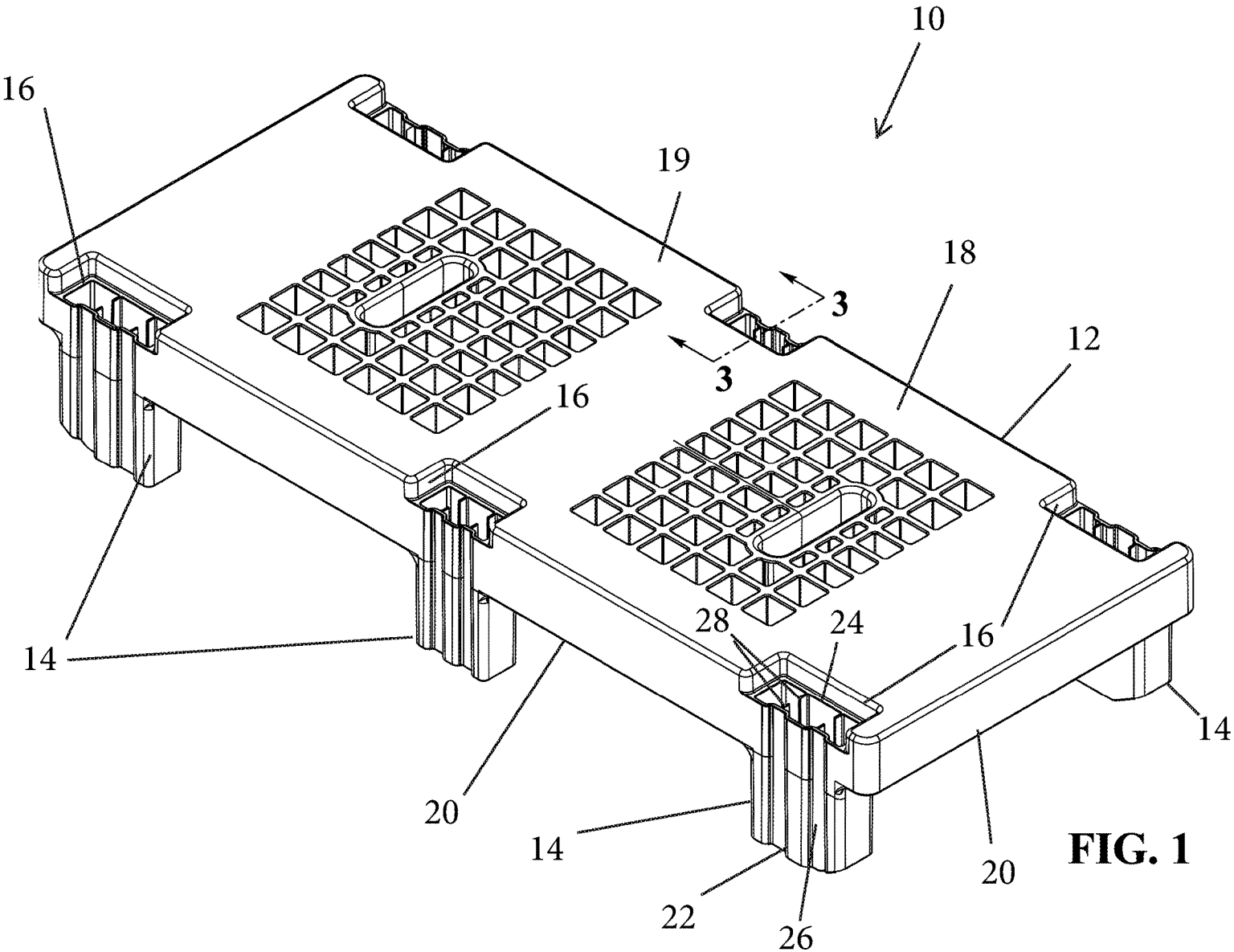
FIG. 1 is a perspective view of a pallet according to a first embodiment.

A pallet 10 according to a first embodiment is shown in FIG. 1. The example pallet 10 shown is a half pallet. The pallet 10 is integrally molded as a single piece of plastic, such as by injection molding. Pallet 10 includes a deck 12 having an upper support surface 18 upon which goods can be supported. The upper surface 18 is defined by an upper planar portion 19 of the deck 12. Feet 14 or columns project downward from the deck 12 to support the deck 12 above the floor. Openings 16 are formed in the upper surface 18 of the deck 12 above each of the feet 14. The openings 16 can receive the feet 14 of an identical deck 10 stacked thereon and partially received in the deck 12 for stability.

The deck 12 further includes a peripheral rib 20 extending downward from a periphery of the upper planar portion 19. Each foot 14 includes a wall 22 defining a periphery of the foot 14. The wall 22 of each foot 14 is recessed from the upper surface of the deck 12 and terminates approximately ⅓ of the height of the peripheral wall 20 of the deck 12 below the upper surface 19 of the deck 12. The upper surface of the wall 22 of each foot 14 protrudes inward of each corresponding opening 16 formed in the upper surface 18 of the deck 12 to form a ledge 24 about the entire periphery of the top of each foot 14.

An outer portion 26 of the wall 22 of each foot 14 is coterminous with the adjacent portion of the peripheral wall 20 of the deck 12. This coterminous outer portion 26 of wall 22 and the peripheral wall 20 does not extend upward to the plane containing the upper surface 19 of the deck 12, but rather is recessed downward therefrom with the rest of the wall 22 of the foot 14. The outer portion 26 of the wall 22 of each foot 14 is in the vertical plane of the outer peripheral wall 20 of the deck 12. The outer portion 26 of the wall 22 of each foot 14 may be corrugated for stiffness and strength, as shown. A plurality of ribs 28 protrude inward from the wall 22 of each foot 14 with an uppermost surface in the same plane as the uppermost surface of the ledge 24.

Figure 2:
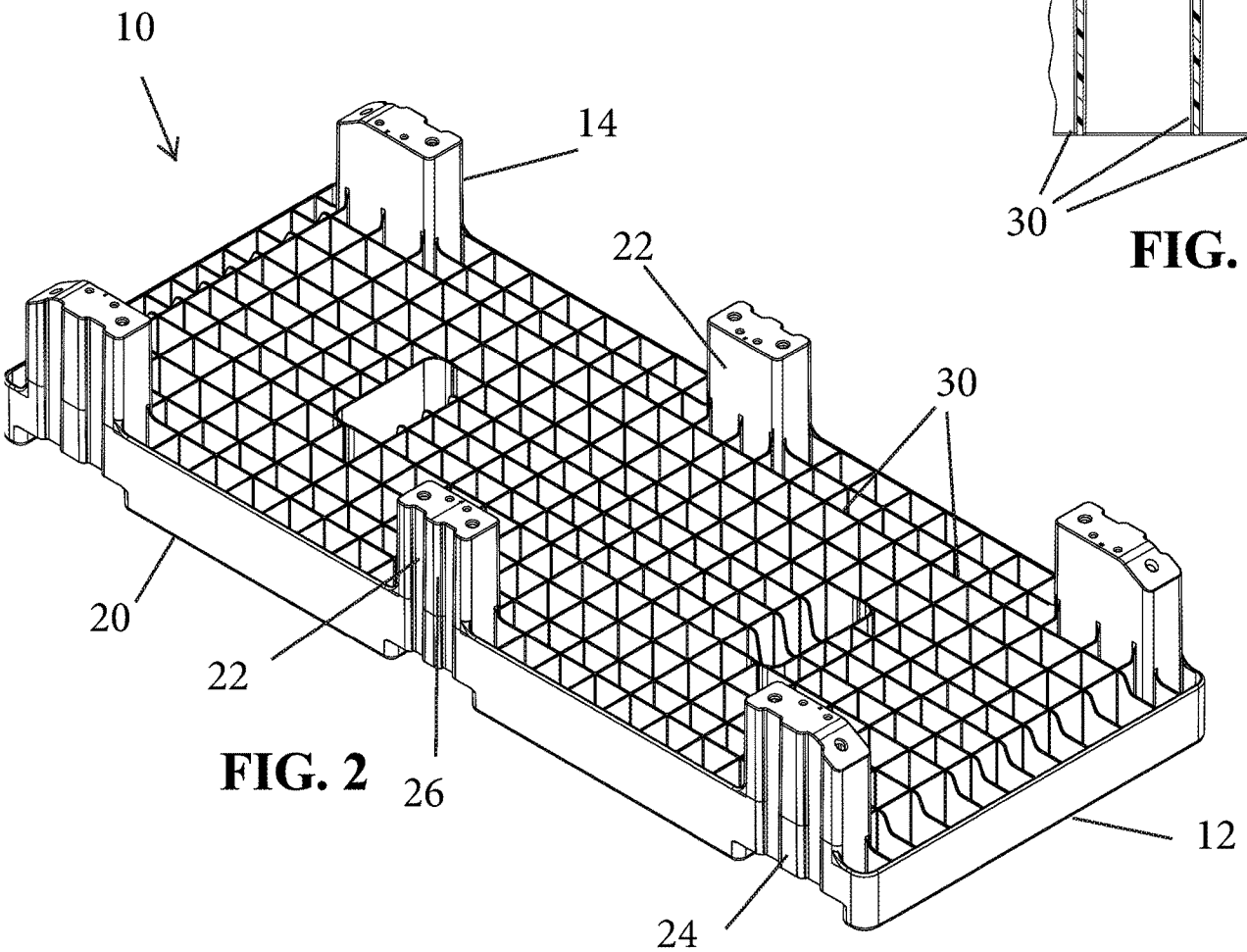
FIG. 2 is a bottom perspective view of the pallet of FIG. 1.

FIG. 2 is a bottom perspective view of the pallet 10. The pallet 10 includes a plurality of intersection ribs 30 extending downward from the upper planar portion 19 (FIG. 1) of the deck 12. The ribs 30 extend downward to a plane containing the lowermost edge of the peripheral wall 20.

Figure 3:
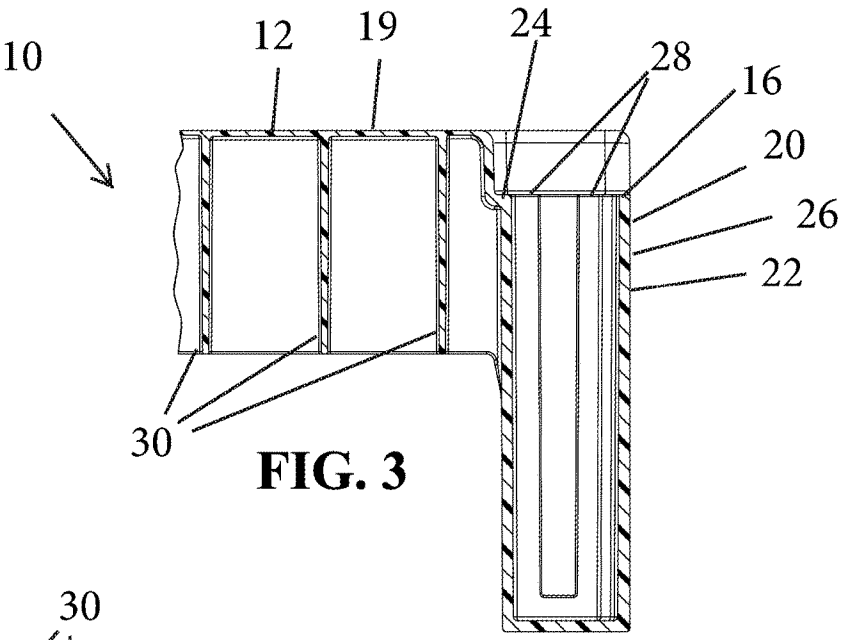
FIG. 3 is a section view taken along line 3-3 of FIG. 1.

FIG. 3 is a section view through one of the feet 14 of the pallet of FIG. 1, taken along line 3-3 of FIG. 1. As shown, the ledge 24 is recessed downward from the upper planar portion 19 of the deck 12. The outer portion 26 of the wall 22 of the foot 14 is coterminous with the peripheral wall 20 of the deck 12. As a result, each recess 16 is open to the outside or the periphery of the pallet 10.

Figure 4:
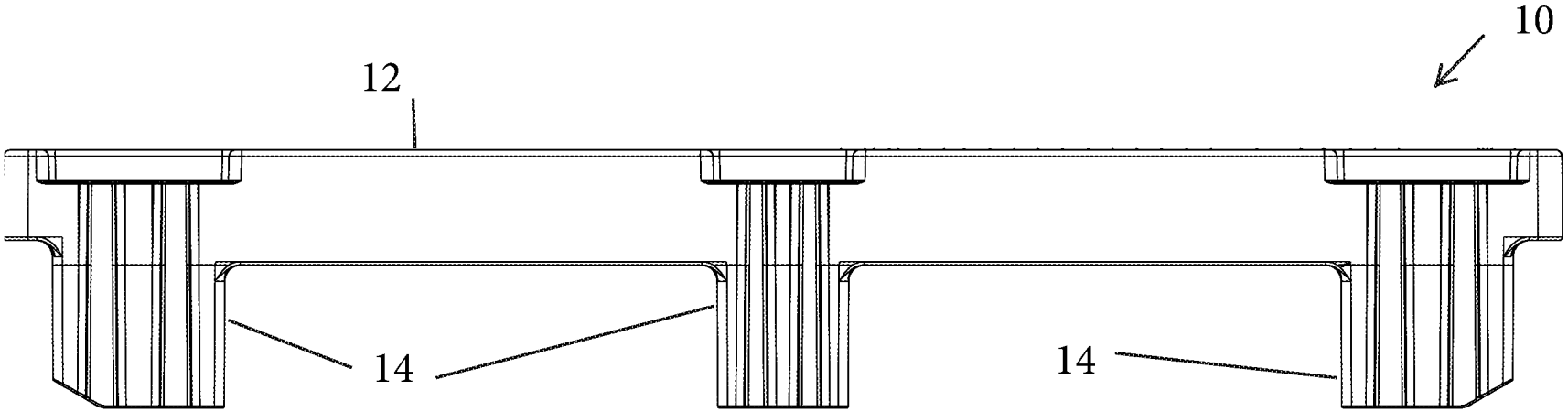
FIG. 4 is a side view of the pallet of FIG. 1.
Figure 5:
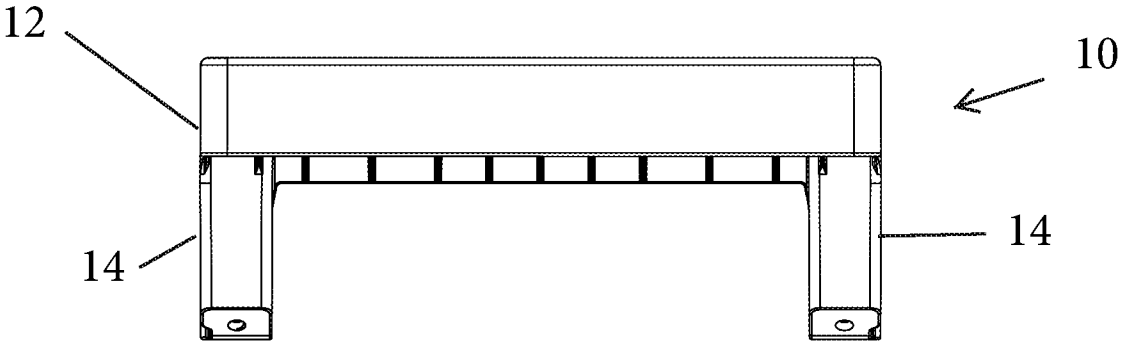
FIG. 5 is an end view of the pallet of FIG. 1.
Figure 6:
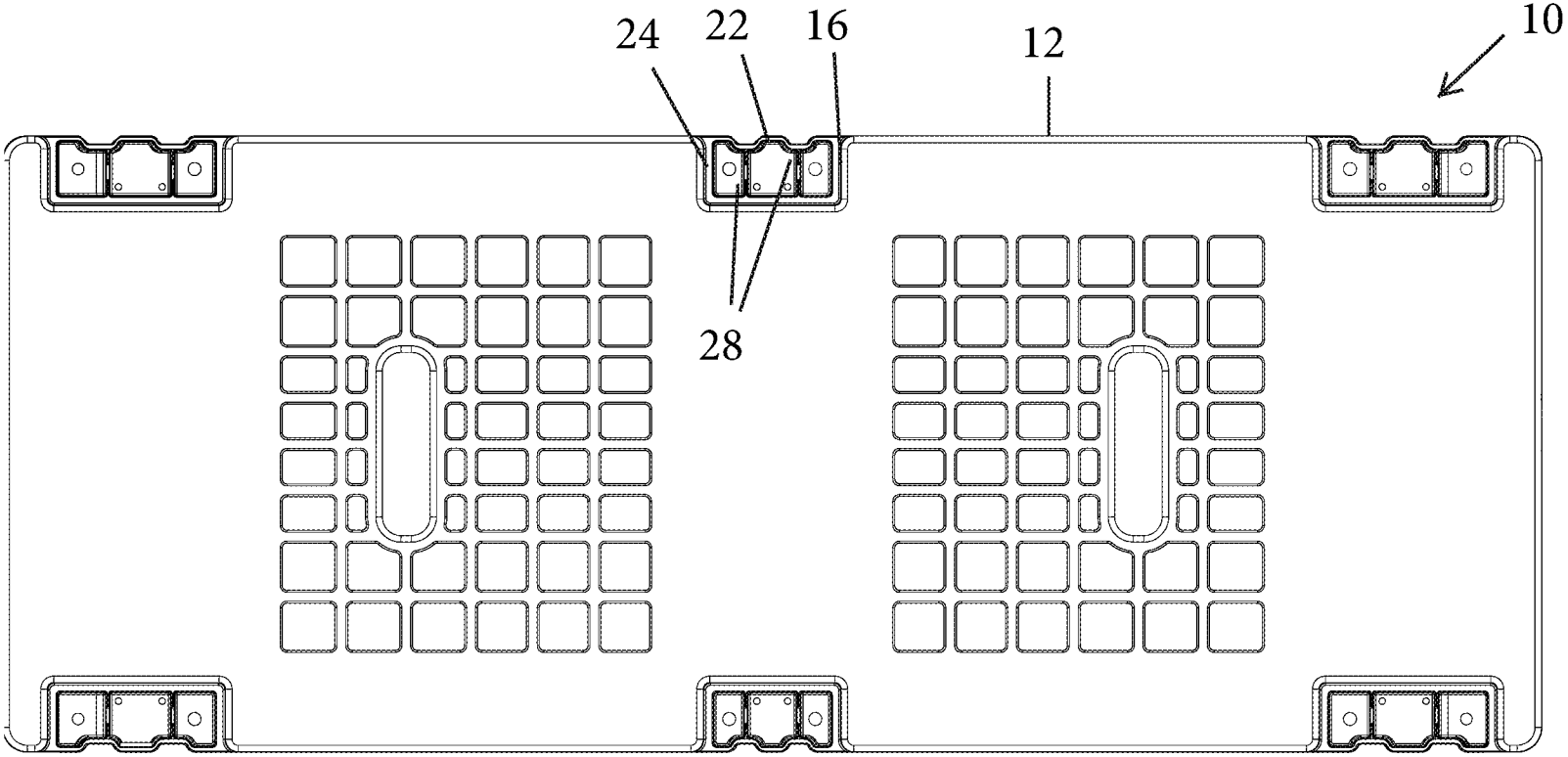
FIG. 6 is a top view of the pallet of FIG. 1.
Figure 7:
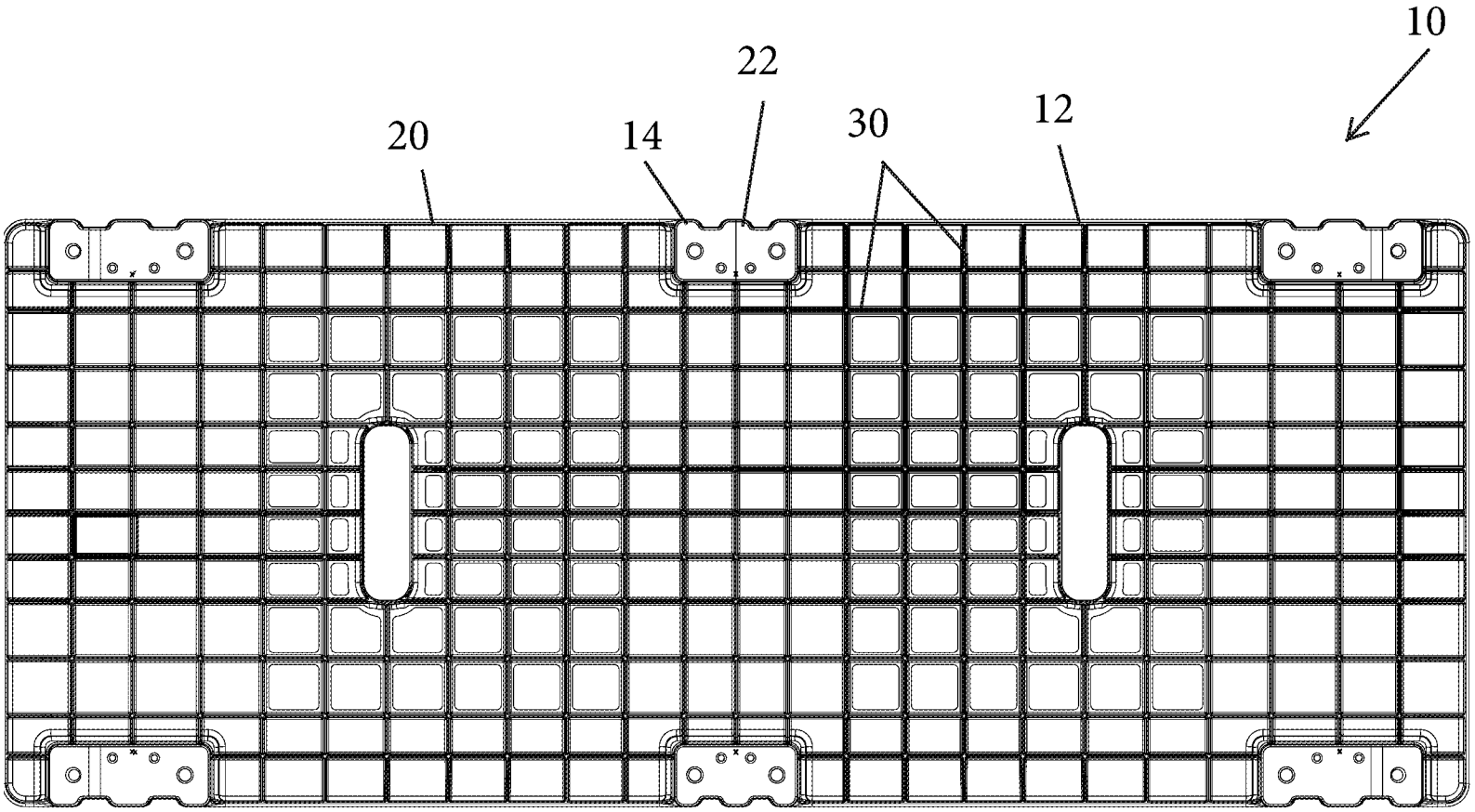
FIG. 7 is a bottom view of the pallet of FIG. 1.

FIG. 4 is a side view of the pallet 10 of FIG. 1. FIG. 5 is an end view of the pallet 10 of FIG. 1. FIG. 6 is a top view of the pallet 10 of FIG. 1. FIG. 7 is a bottom view of the pallet 10 of FIG. 1.

Figure 8:
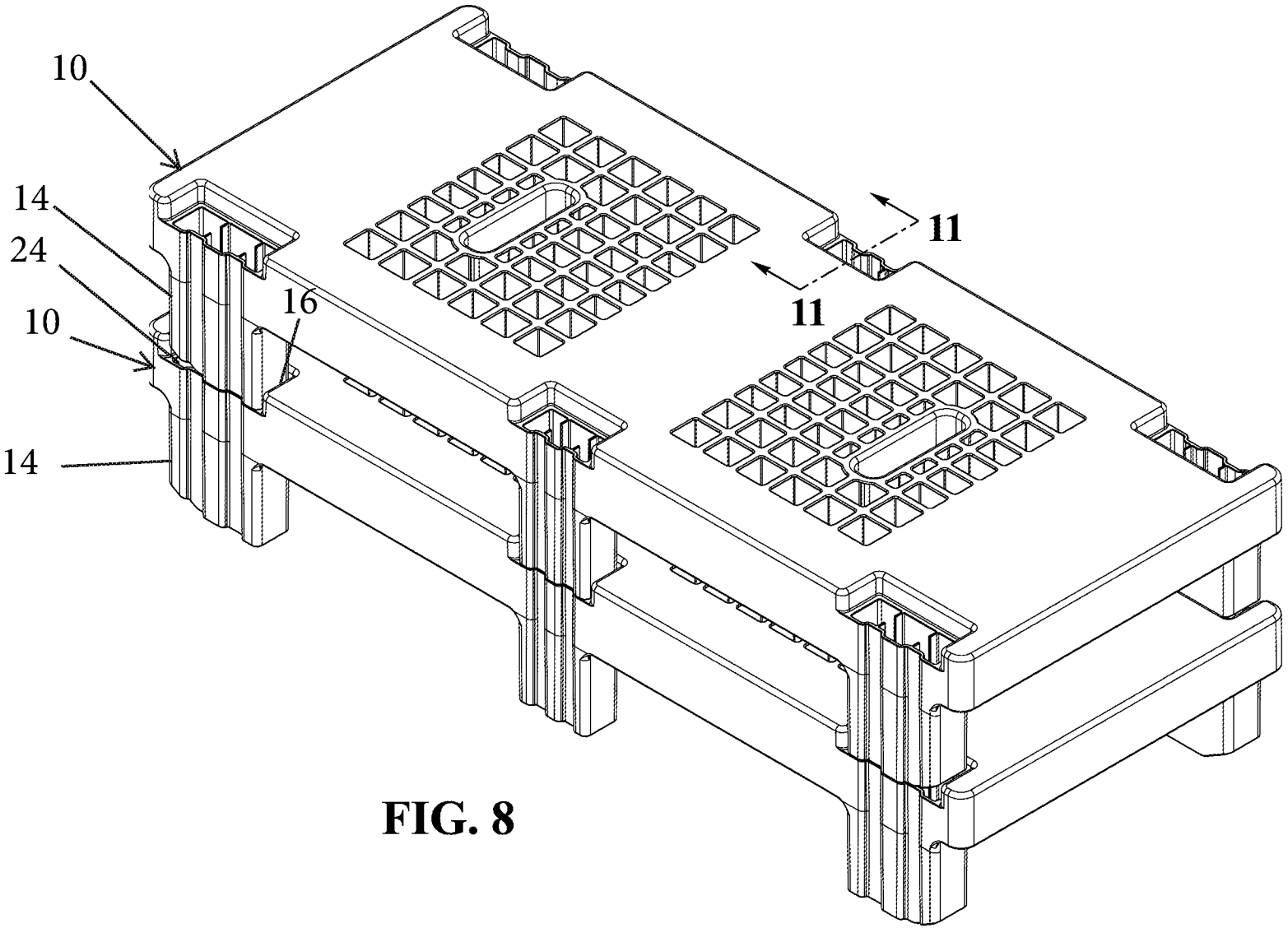
FIG. 8 shows the pallet of FIG. 1 stacked with an identical pallet.

FIG. 8 is a perspective view of the pallet 10 of FIG. 1 with an identical pallet 10 stacked thereon. The feet 14 of the upper pallet 10 are received in the recesses 16 in the deck 12 of the lower pallet 10. The feet 14 of the upper pallet 10 are stacked on the ledge 24 and ribs 28. The corrugations in the outer portion 26 of the wall 22 of the feet 16 of the upper pallet 10 mate with the corrugations on the feet 14 of the lower pallet 10. The recesses 16 reduce the overall stacking height of the empty pallets 10 and increase the stability of the stack.

Figure 9:
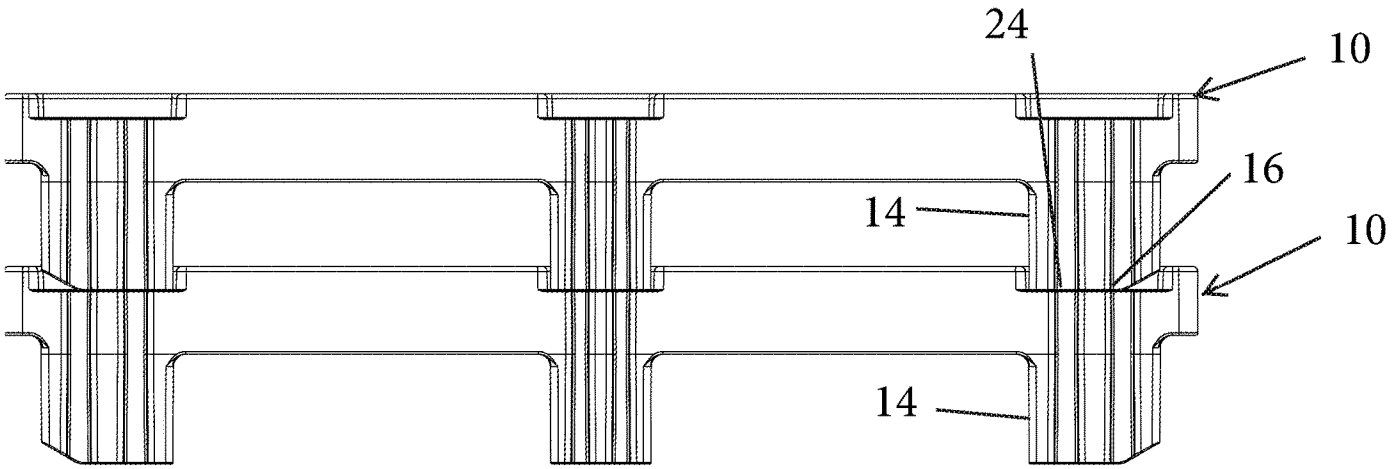
FIG. 9 is a side view of the pallets of FIG. 8.
Figure 10:
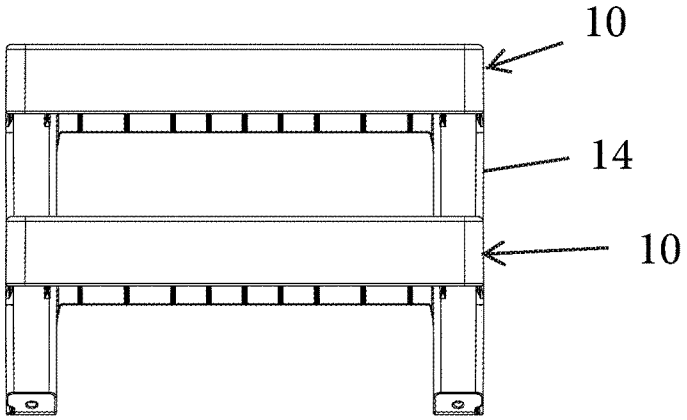
FIG. 10 is an end view of the pallets of FIG. 8.

FIG. 9 is a side view of the stacked pallets 10. FIG. 10 is an end view of the stacked pallets 10.

Figure 11:
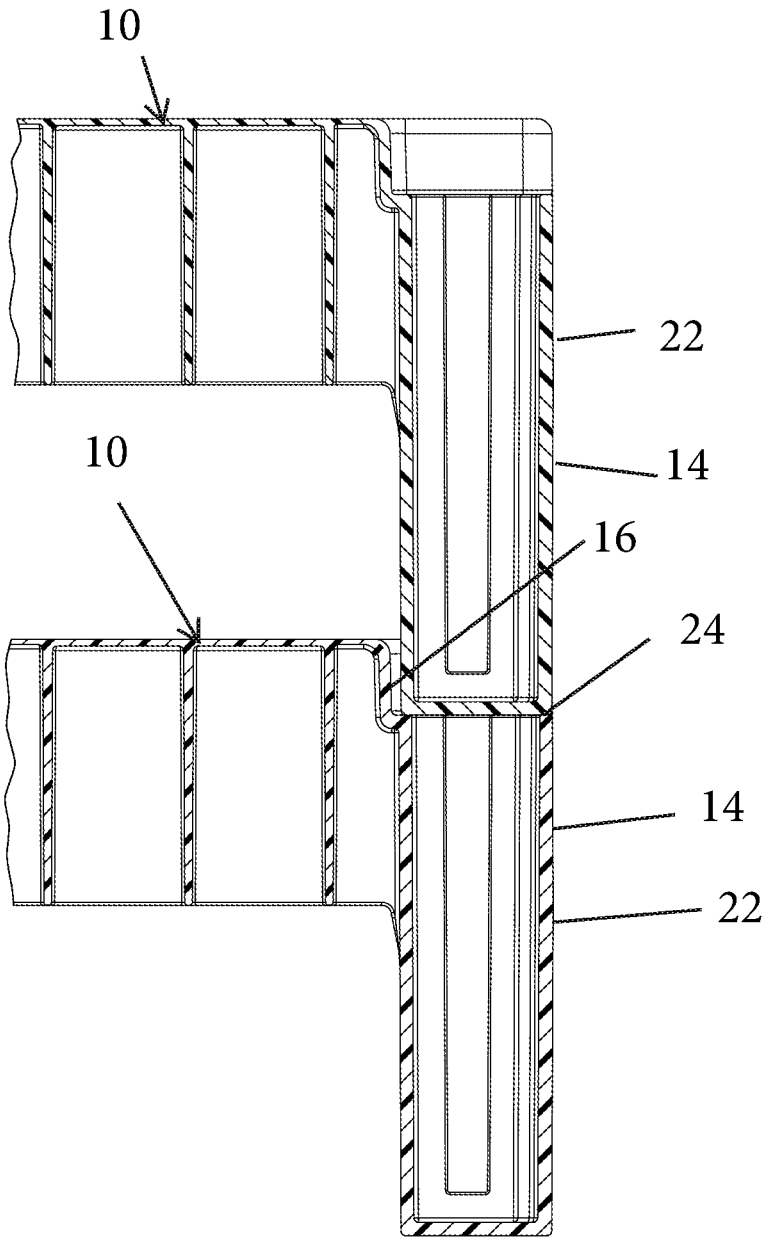
FIG. 11 is a section view taken long line 11-11 of FIG. 8.

FIG. 11 is a section view through the feet 14 of the stacked pallets 10. The feet 14 of the upper pallet 10 are received in the recesses 16 of the lower pallet 10, with the walls 22 of the feet 14 of the upper pallet 10 supported on the ledge 24 of the feet 14 of the lower pallet 10, i.e. the upper surfaces of the walls 22 of the feet 14 of the lower pallet 10.

Figure 12:
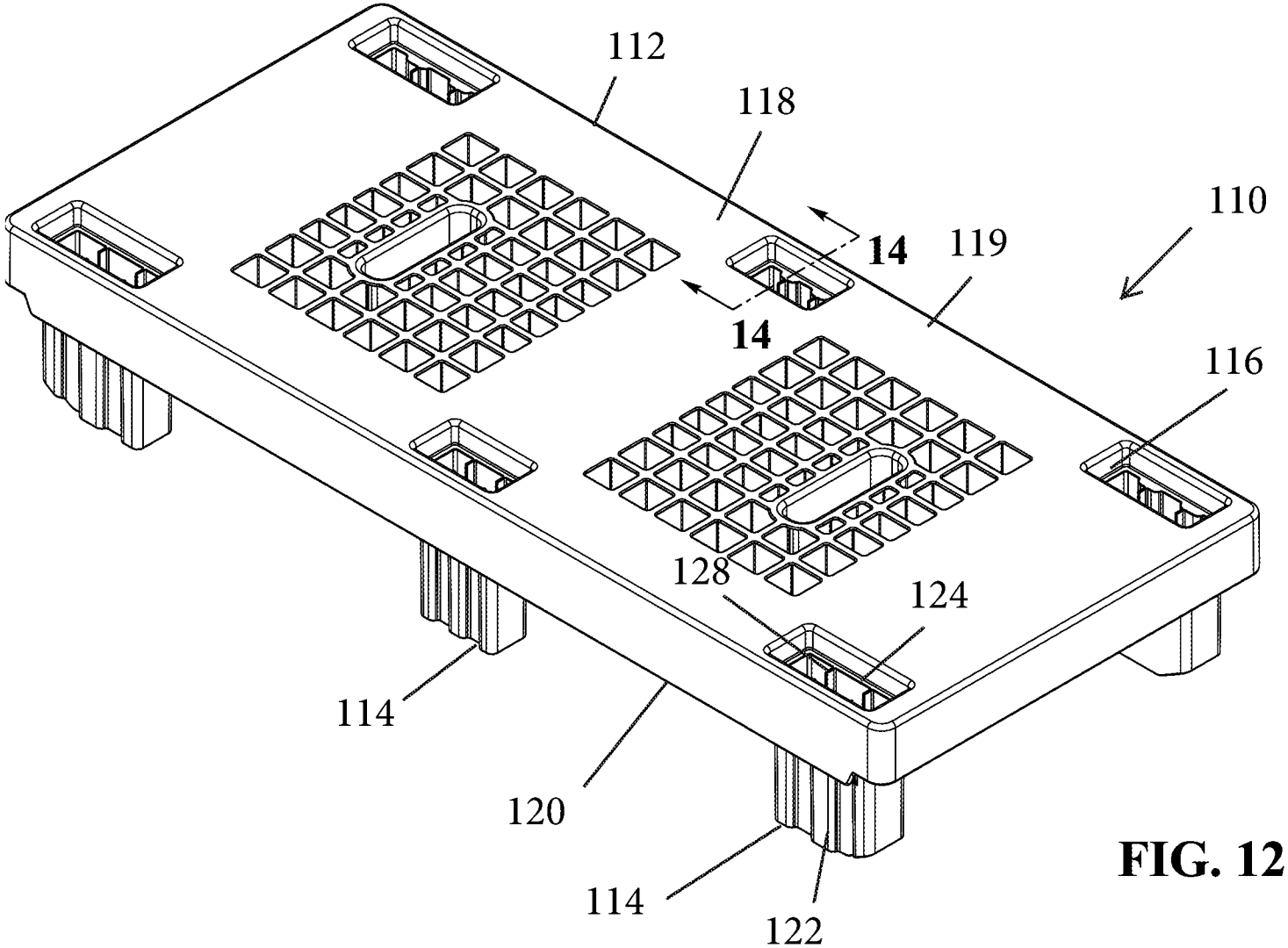
FIG. 12 is a perspective view of a pallet according to a second embodiment.

A pallet 110 according to a second embodiment is shown in FIG. 12. The example pallet 110 shown is a half pallet. The pallet 110 is identical to the pallet 10 of FIGS. 1-11 except as described below or shown in in the Figures. As will be explained further below, the two pallets 10, 110 together are part of a system and can stack with one another. In particular, the pallet 110 has a wider deck 112 than the pallet 10 but has identical spacing of feet 114. For example, the pallet 110 may have a deck 112 width of 20.7 inches, while the pallet 10 may have a deck 12 width of 19 inches.

The pallet 110 is integrally molded as a single piece of plastic, such as by injection molding. Pallet 110 includes the deck 112 having an upper support surface 118 upon which goods can be supported. The upper surface 118 is defined by an upper planar portion 119 of the deck 112. Feet 114 project downward from the deck 112 to support the deck 112 above the floor. Openings 116 are formed in the upper surface 118 of the deck 112 above each of the feet 114. The openings 116 can receive the feet 114 of an identical deck 110 stacked thereon and partially received in the deck 112 for stability.

The deck 112 further includes a peripheral rib 120 extending downward from a periphery of the upper planar portion 119. Each foot 114 includes a wall 122 defining a periphery of the foot 114. The wall 122 of each foot 114 is recessed from the upper surface of the deck 112 and terminates approximately ⅓ of the height of the peripheral wall 120 of the deck 112 below the upper surface 119 of the deck 112. The upper surface of the wall 122 of each foot 114 protrudes inward of each corresponding opening 116 formed in the upper surface 118 of the deck 112 to form a ledge 124 about the entire periphery of the top of each foot 114.

In this embodiment, the outer portion 126 of the wall 122 of each foot 114 is spaced inward of the peripheral wall 120 of the deck 112 because the deck 112 is wider. The outer portion 126 of the wall 122 of each foot 114 may be corrugated for stiffness and strength, as shown. A plurality of ribs 128 protrude inward from the wall 122 of each foot 114 with an uppermost surface in the same plane as the uppermost surface of the ledge 124.

Figure 13:
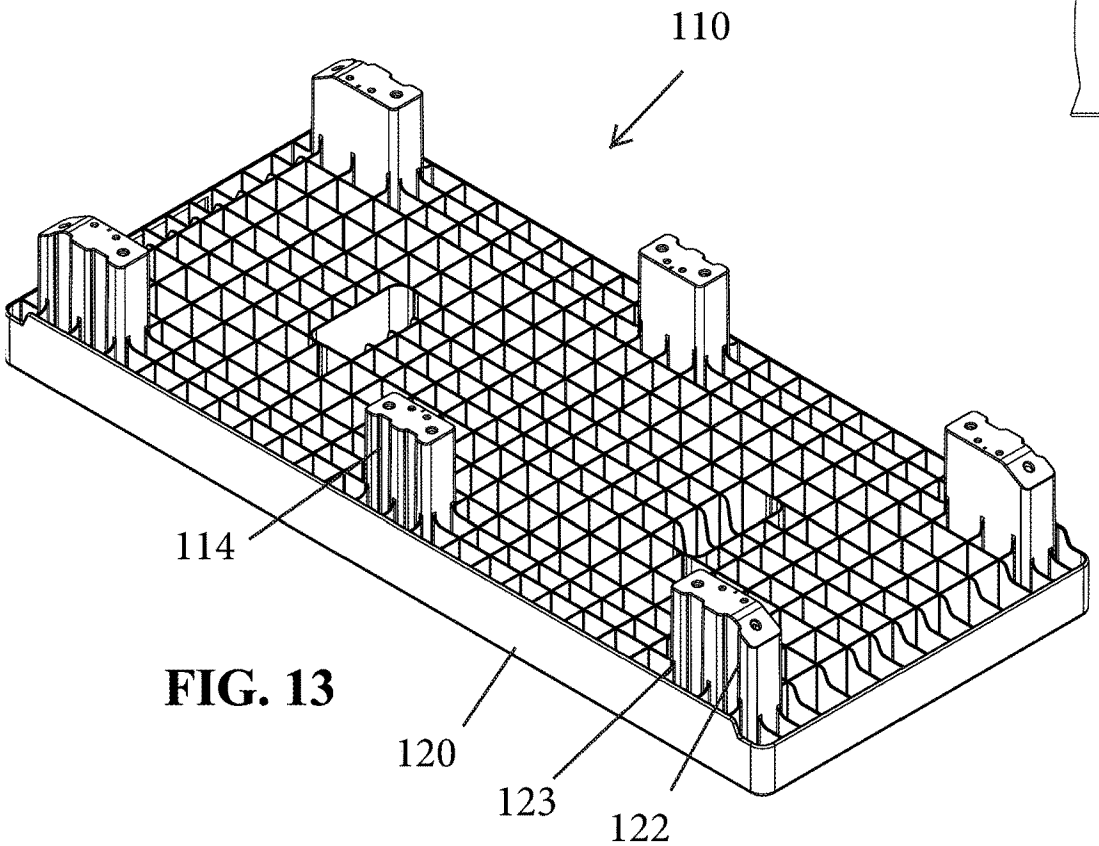
FIG. 13 is a bottom perspective view of the pallet of FIG. 12.

FIG. 13 is a bottom perspective view of the pallet 110. The pallet 110 includes a plurality of intersecting ribs 130 extending downward from the upper planar portion 119 (FIG. 1) of the deck 112. The ribs 130 extend downward to a plane containing the lowermost edge of the peripheral wall 120. Gussets 123 may connect the peripheral wall 120 of the deck 112 to the wall 122 of the feet 114.

Figure 14:
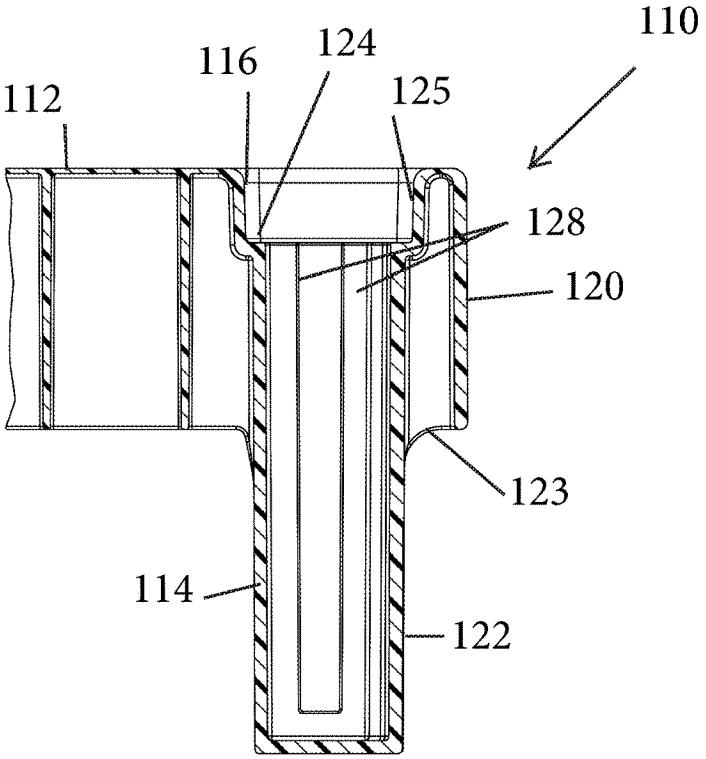
FIG. 14 is a section view taken along line 14-14 of FIG. 12.

FIG. 14 is a section view through one of the feet 114 of the pallet of FIG. 12, taken along line 14-14 of FIG. 12. As shown, the ledge 124 is recessed downward from the upper planar portion 119 of the deck 112. The outer portion 126 of the wall 122 of the foot 114 is spaced inward from the peripheral wall 120 of the deck 112. Each recess 116 is closed to the outside or the periphery of the pallet 110 by the peripheral wall 120 and an inner peripheral wall 125. In this manner, the deck 112 of this embodiment is wider than the deck 10 of the previous embodiment, with the feet 14, 114 having the same spacing.

Figure 15:
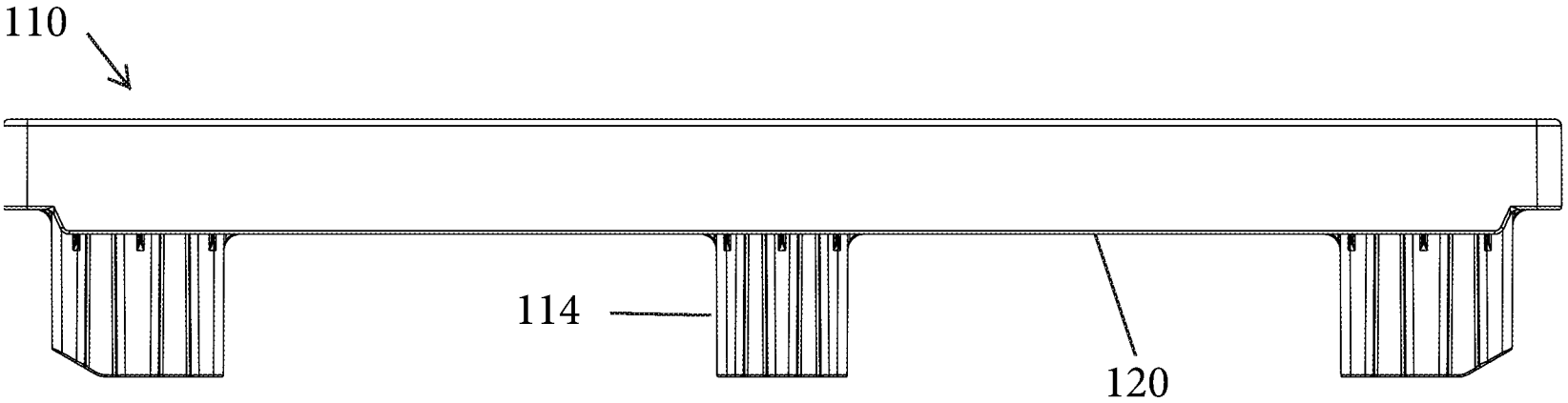
FIG. 15 is a side view of the pallet of FIG. 12.
Figure 16:
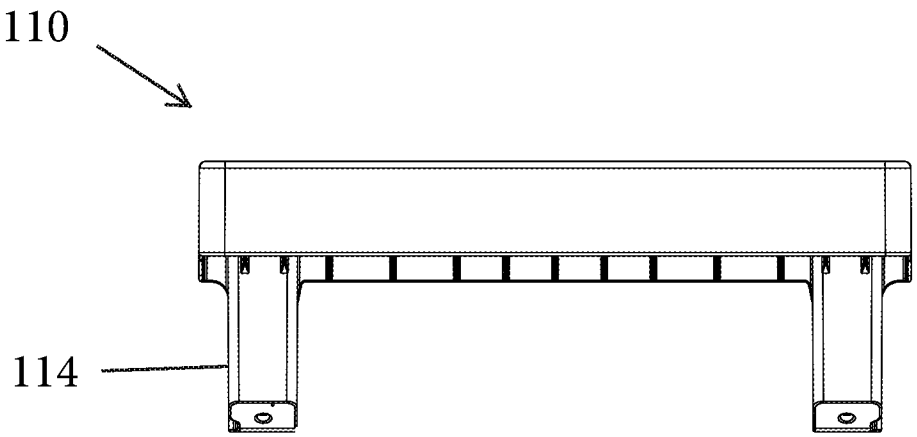
FIG. 16 is an end view of the pallet of FIG. 12.
Figure 17:
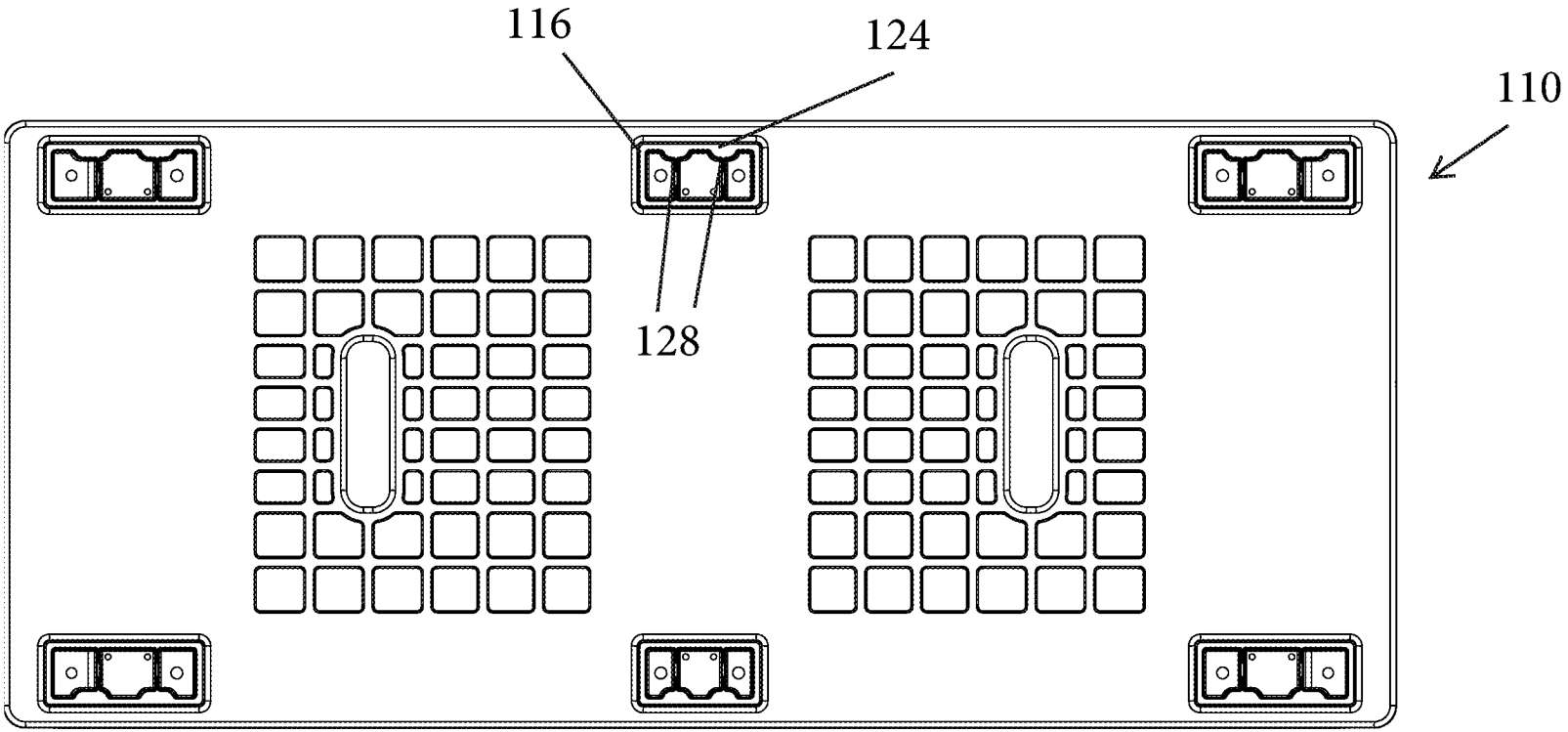
FIG. 17 is a top view of the pallet of FIG. 12.
Figure 18:
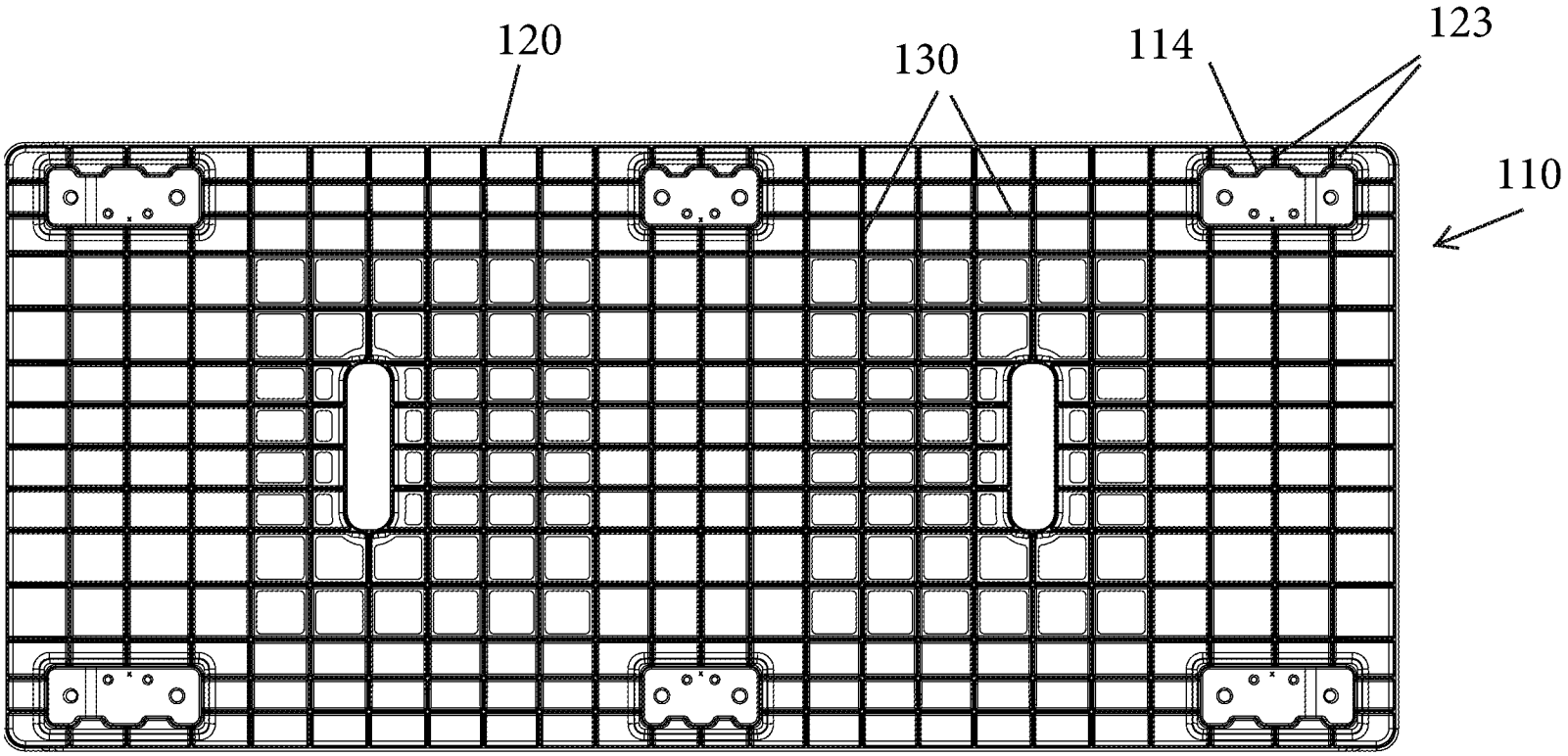
FIG. 18 is a bottom view of the pallet of FIG. 12.

FIG. 15 is a side view of the pallet 110 of FIG. 12. FIG. 16 is an end view of the pallet 110 of FIG. 12. FIG. 17 is a top view of the pallet 110 of FIG. 12. FIG. 18 is a bottom view of the pallet 110 of FIG. 1.

Figure 19:
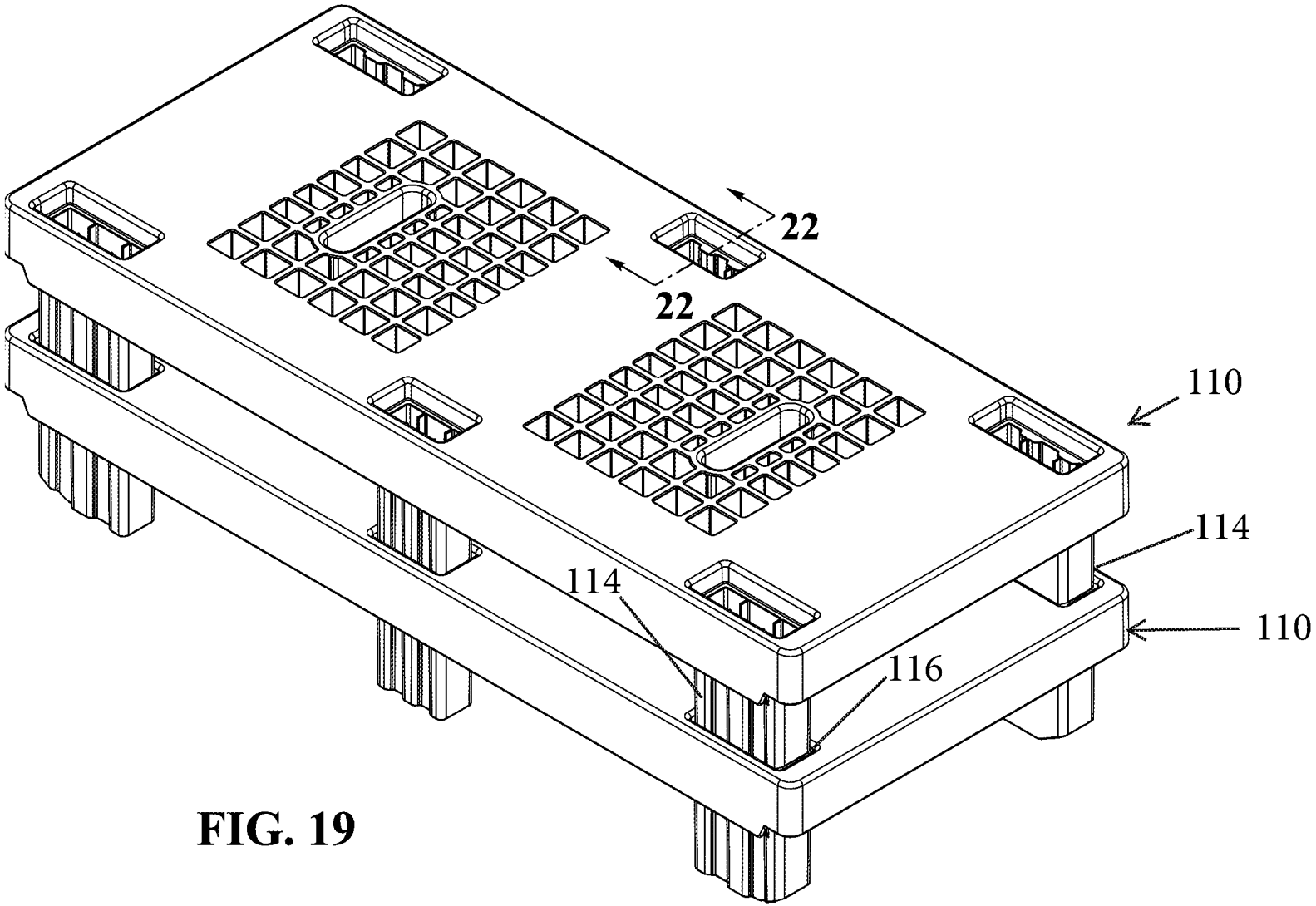
FIG. 19 shows the pallet of FIG. 12 stacked with an identical pallet.

FIG. 19 is a perspective view of the pallet 110 of FIG. 12 with an identical pallet 110 stacked thereon. The feet 114 of the upper pallet 110 are received in the recesses 116 in the deck 112 of the lower pallet 110. The feet 114 of the upper pallet 110 are stacked on the ledge 124 and ribs 128. The corrugations in the outer portion 126 of the wall 122 of the feet 116 of the upper pallet 110 mate with the corrugations on the feet 114 of the lower pallet 110. The recesses 116 reduce the overall stacking height of the empty pallets 110 and increase the stability of the stack.

Figure 20:
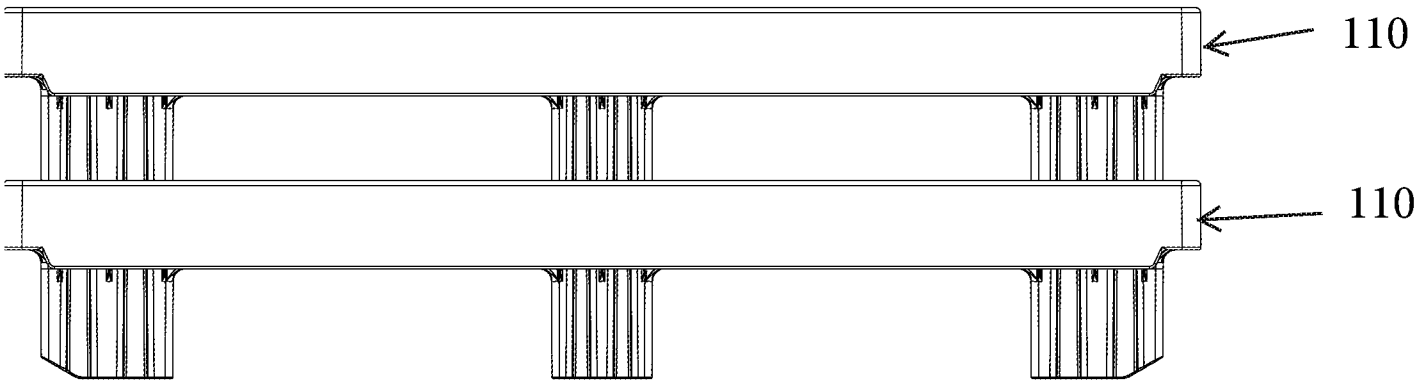
FIG. 20 is a side view of the pallets of FIG. 12.
Figure 21:
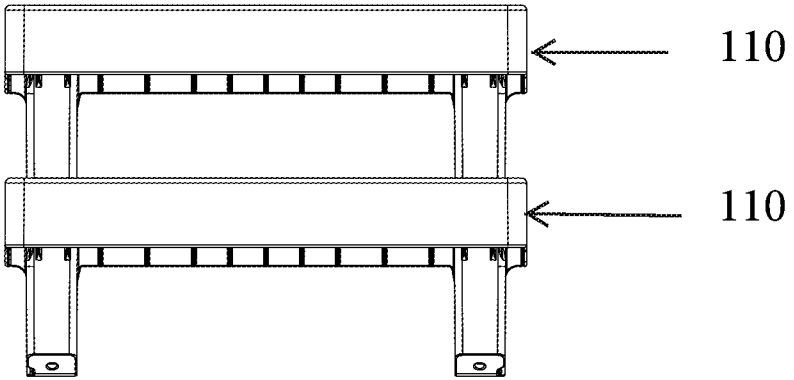
FIG. 21 is an end view of the pallets of FIG. 12.

FIG. 20 is a side view of the stacked pallets 110. FIG. 21 is an end view of the stacked pallets 110.

Figure 22:
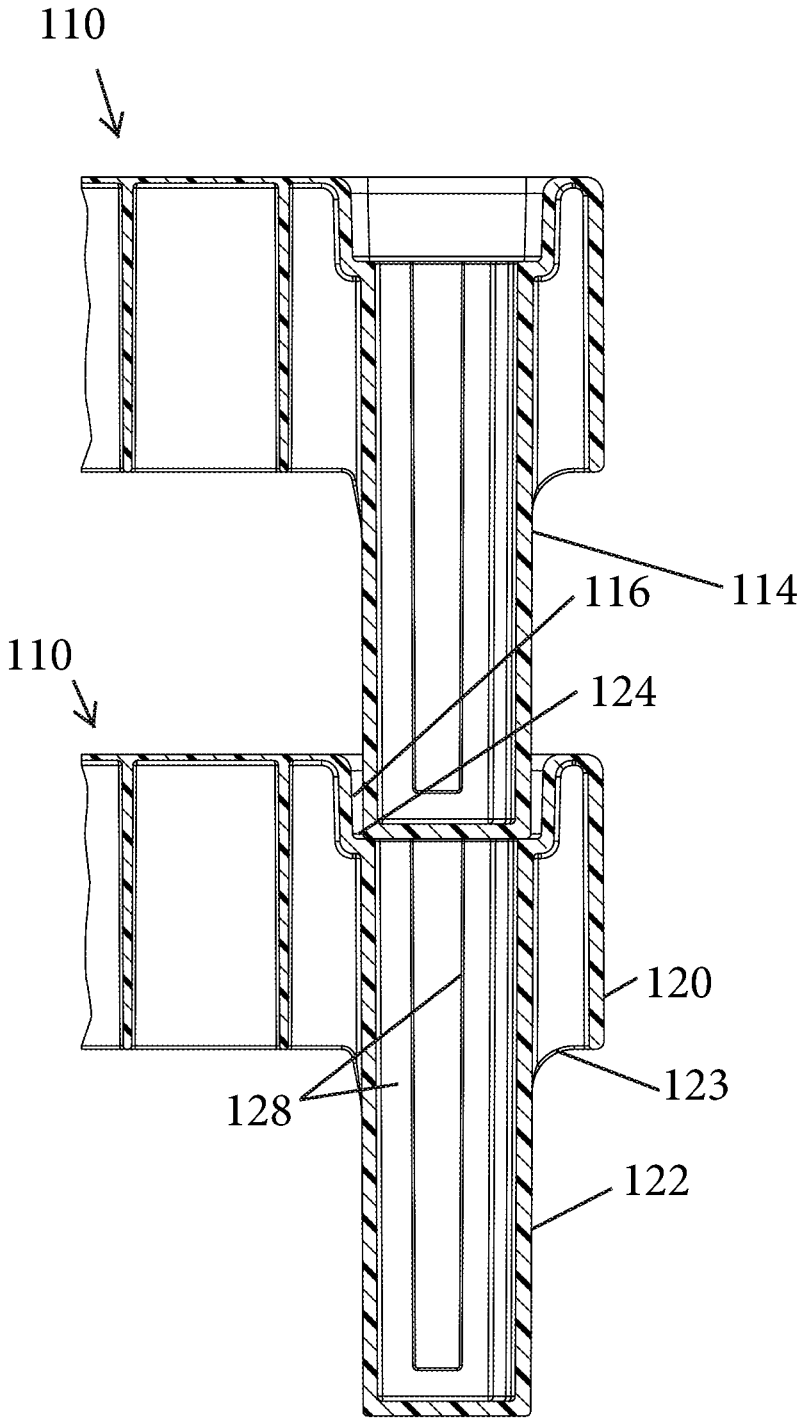
FIG. 22 is a section view taken long line 22-22 of FIG. 19.

FIG. 22 is a section view through the feet 114 of the stacked pallets 110. The feet 114 of the upper pallet 110 are received in the recesses 116 of the lower pallet 110, with the walls 122 of the feet 114 of the upper pallet 110 supported on the ledge 124 of the feet 114 of the lower pallet 110, i.e. the upper surfaces of the walls 122 of the feet 114 of the lower pallet 110.

Figure 23:
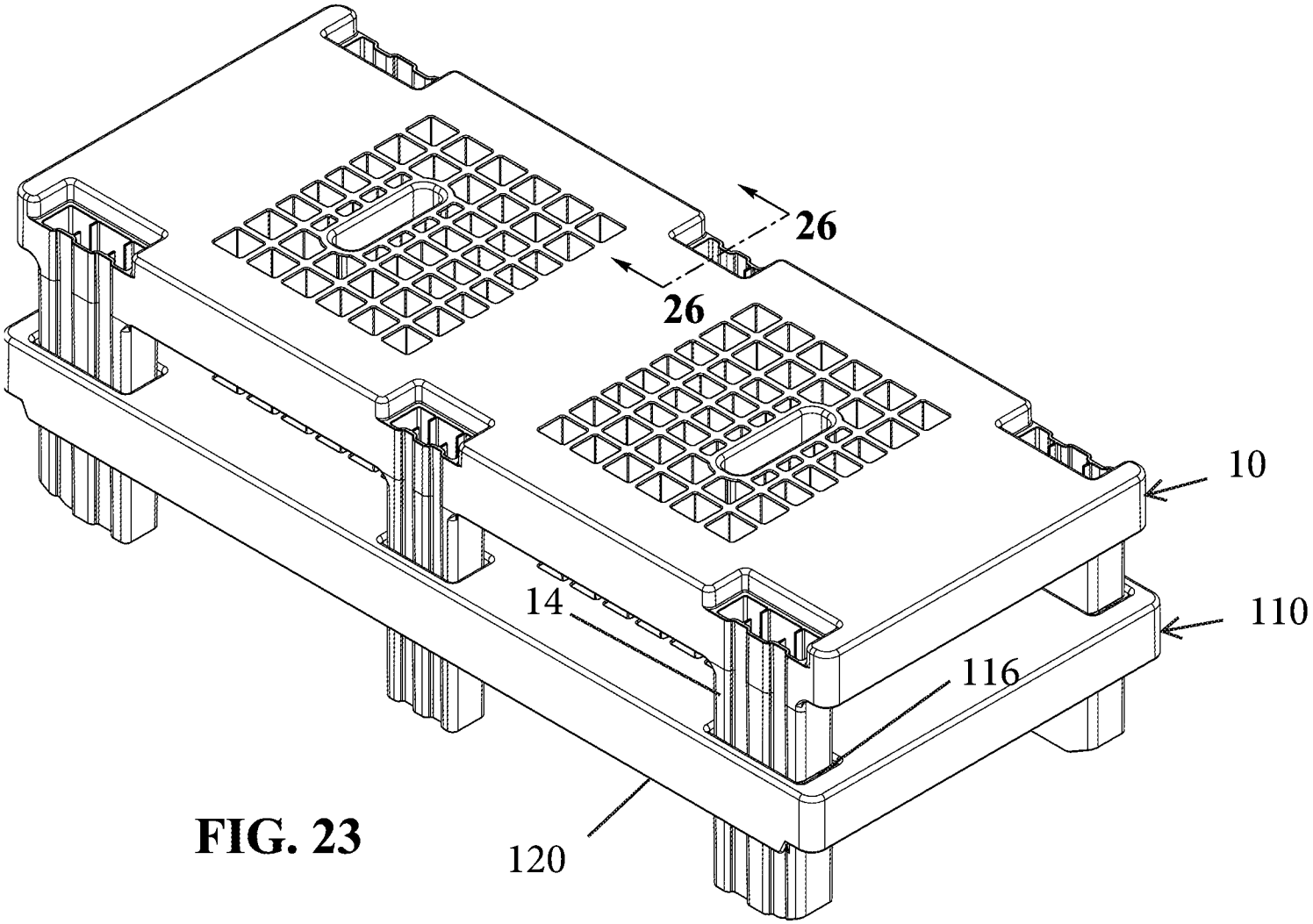
FIG. 23 is a perspective view of the pallet of FIG. 1 stacked on the pallet of FIG. 12.

FIG. 23 is a perspective view of the wider pallet 110 of FIG. 12 with the narrower pallet 10 of FIG. 1 stacked thereon. The feet 14 of the narrower pallet 10 are received in the recesses 116 in the deck 112 of the wider pallet 110. The feet 14 of the upper pallet 10 are stacked on the ledge 124 and ribs 128. The corrugations in the outer portion 26 of the wall 22 of the feet 16 of the upper, narrower pallet 10 mate with the corrugations on the feet 114 of the lower, wider pallet 110. The recesses 116 reduce the overall stacking height of the empty pallets 10, 110 and increase the stability of the stack.

Figure 24:
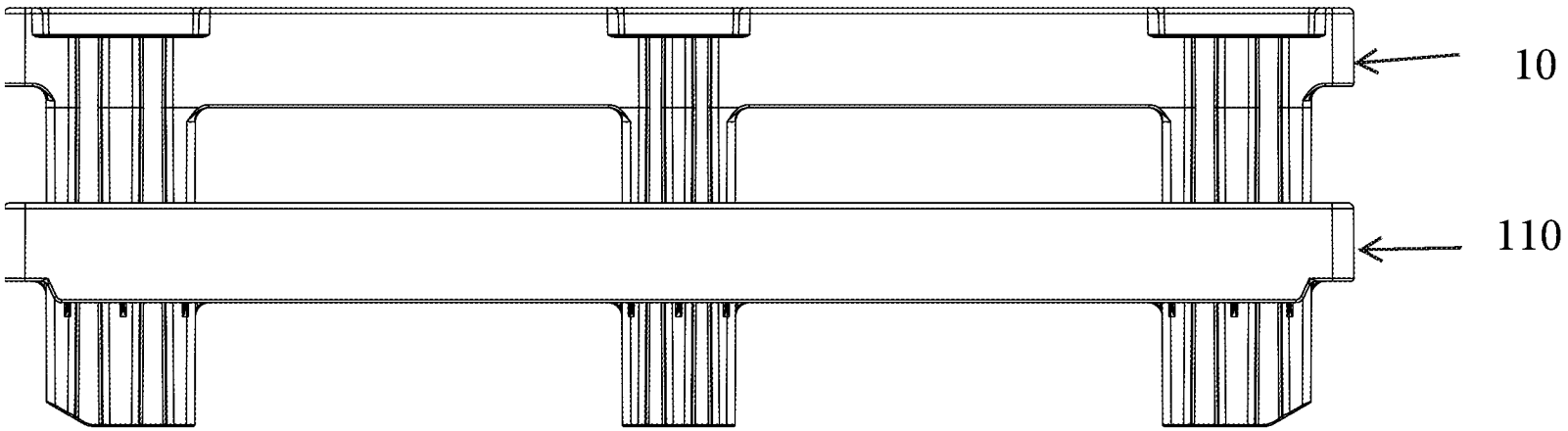
FIG. 24 is a side view of the pallets of FIG. 23.
Figure 25:
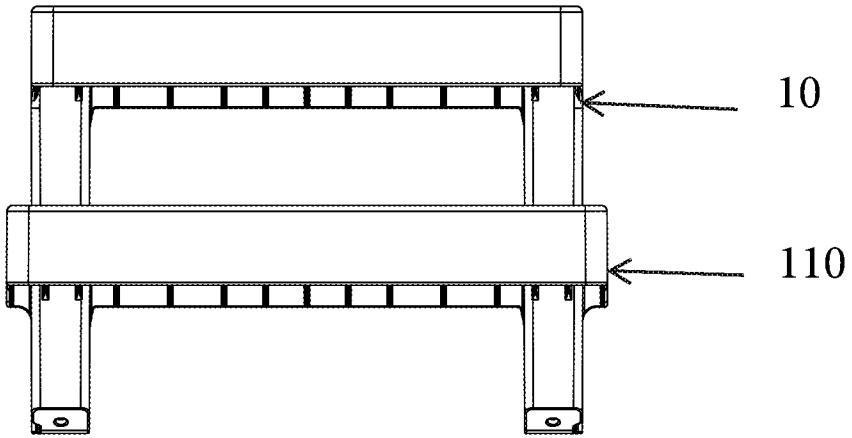
FIG. 25 is an end view of the pallets of FIG. 23.

FIG. 24 is a side view of the stacked pallets 10, 110. FIG. 25 is an end view of the stacked pallets 10, 110.

Figure 26:
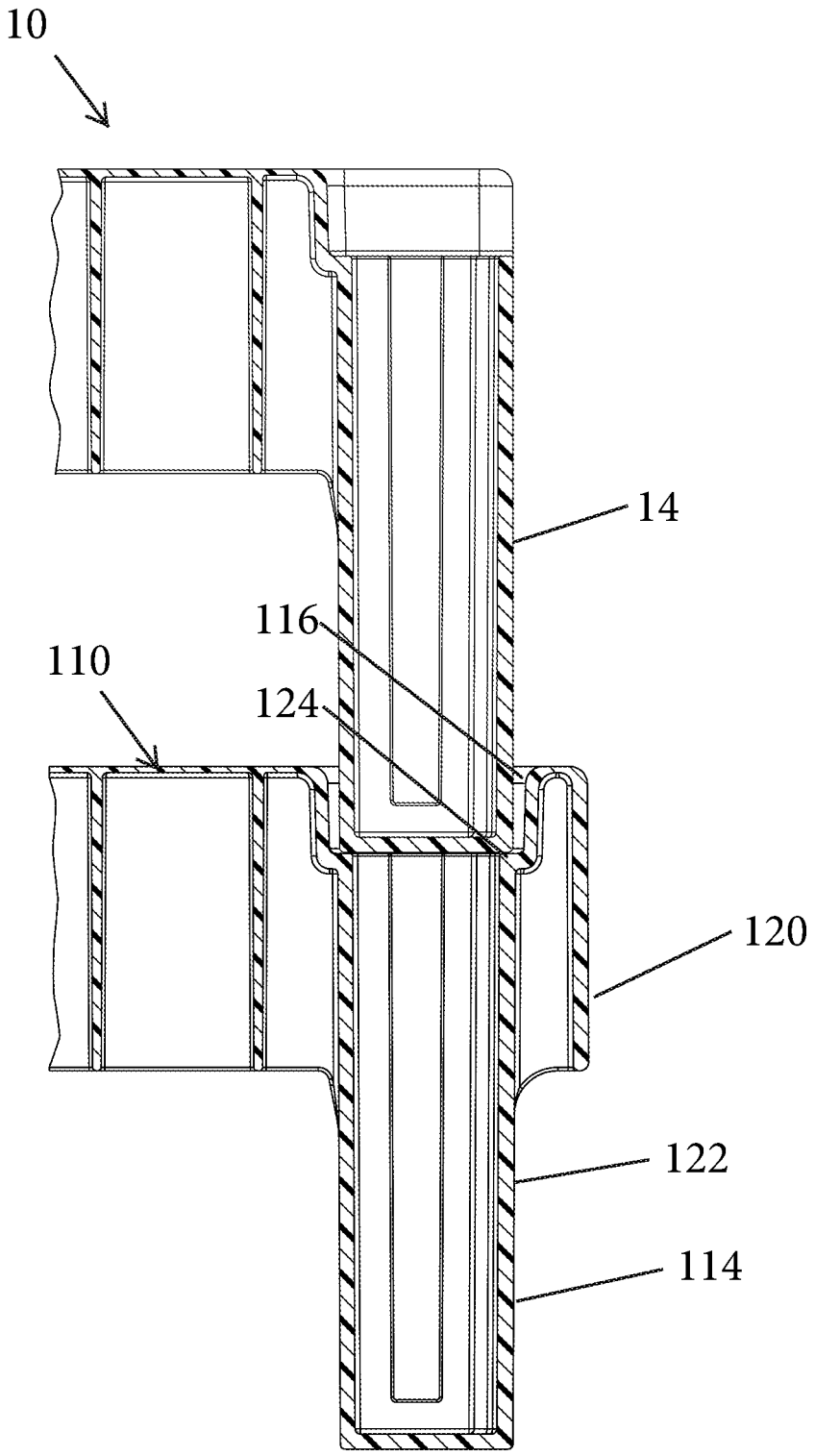
FIG. 26 is a section view taken along line 26-26 of FIG. 23.

FIG. 26 is a section view through the feet 14, 114 of the stacked pallets 10, 110. The feet 14 of the upper pallet 10 are received in the recesses 116 of the lower pallet 110, with the walls 22 of the feet 14 of the upper pallet 10 supported on the ledge 124 of the feet 114 of the lower pallet 110, i.e. the upper surfaces of the walls 122 of the feet 114 of the lower pallet 110.

Figure 27:
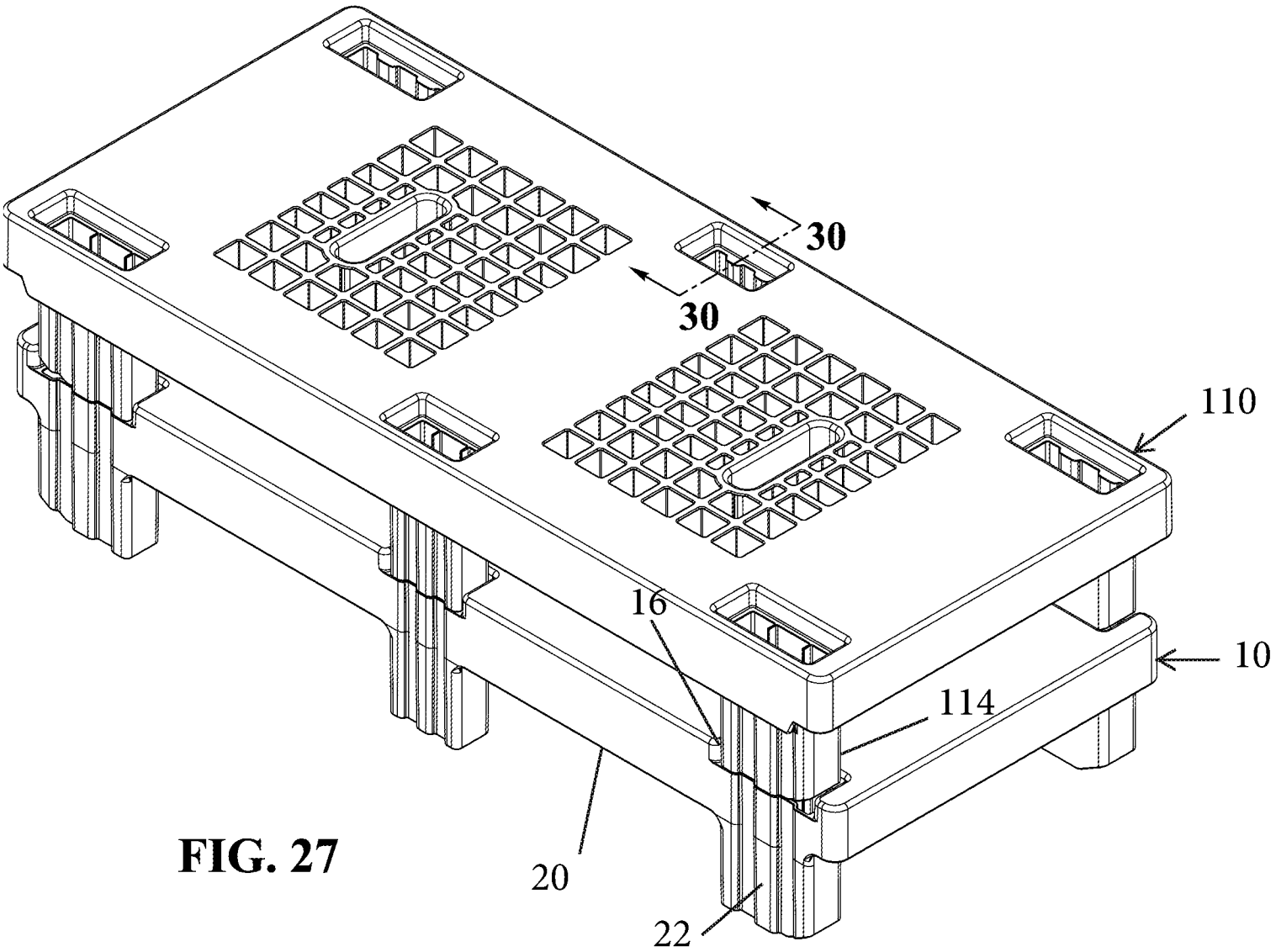
FIG. 27 is a perspective view of the pallet of FIG. 12 stacked on the pallet of FIG. 1.

As shown in FIG. 27, the wider pallet 110 can also be stacked on the narrower pallet 10. The feet 114 of the upper, wider pallet 110 are received in the recesses 16 in the deck 12 of the lower, narrower pallet 10. The feet 114 of the upper pallet 110 are stacked on the ledge 24 and ribs 28. The corrugations in the outer portion 126 of the wall 122 of the feet 116 of the upper, wider pallet 110 mate with the corrugations on the feet 14 of the lower, narrower pallet 10. The recesses 16 reduce the overall stacking height of the empty pallets 10, 110 and increase the stability of the stack.

Figure 28:
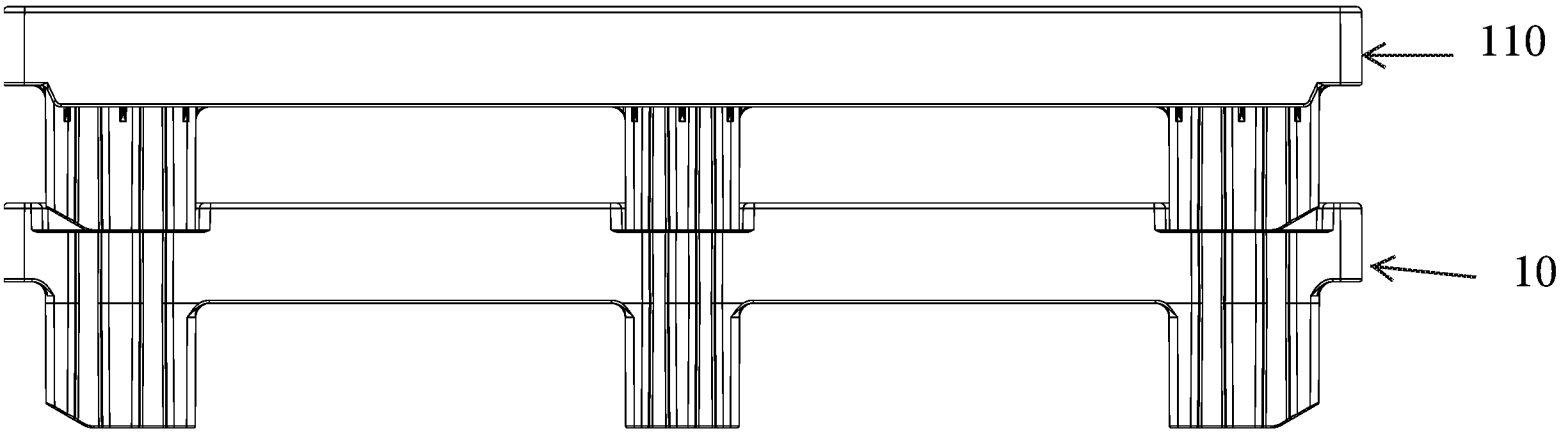
FIG. 28 is a side view of the pallets of FIG. 27.
Figure 29:
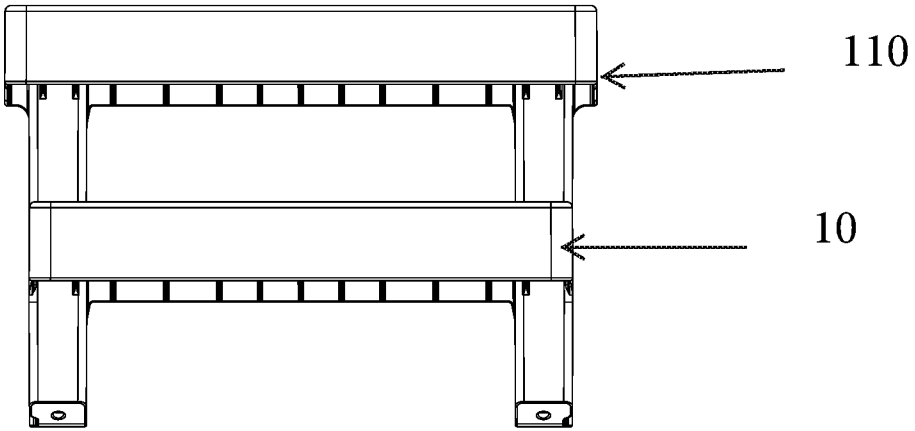
FIG. 29 is an end view of the pallets of FIG. 27.

FIG. 28 is a side view of the stacked pallets 10, 110. FIG. 29 is an end view of the stacked pallets 10, 110.

Figure 30:
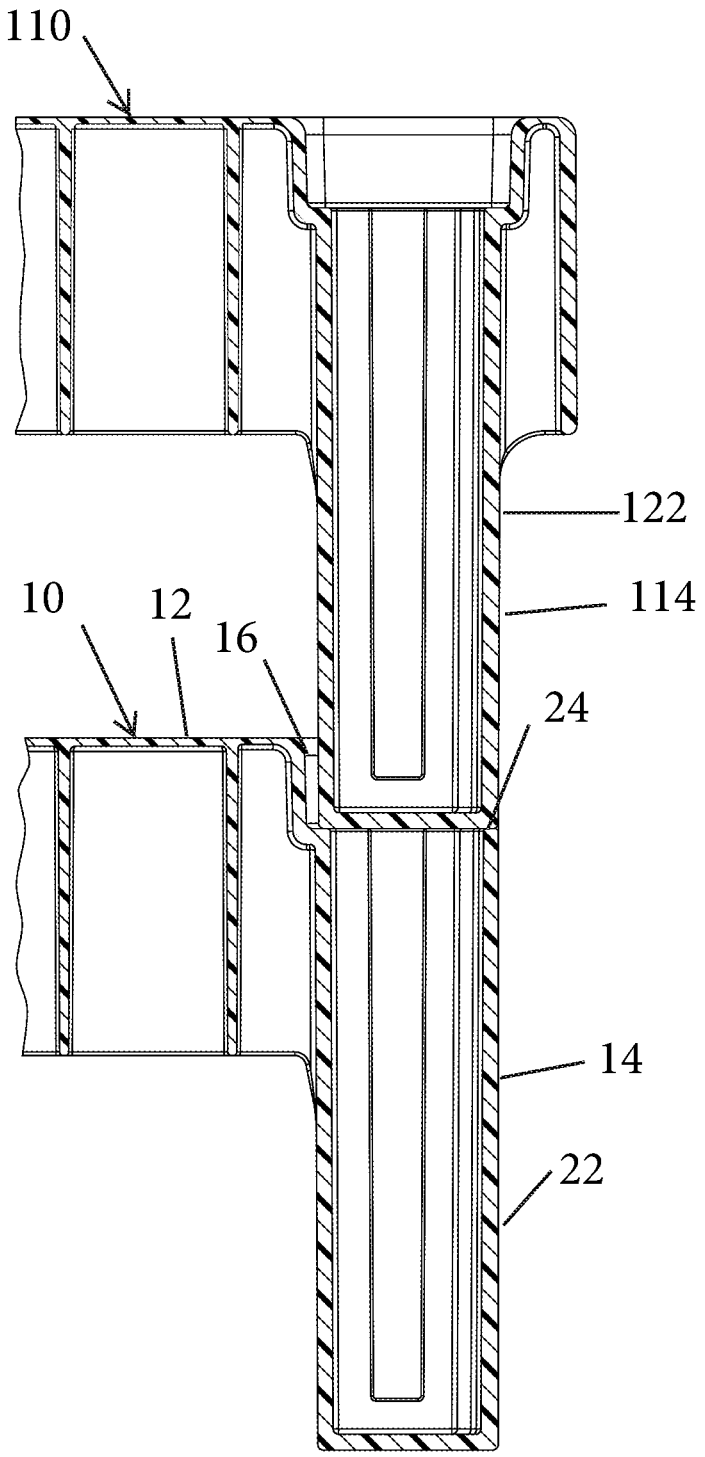
FIG. 30 is a section view taken along line 30-30 of FIG. 27.

FIG. 30 is a section view through the feet 14, 114 of the stacked pallets 10, 110. The feet 114 of the upper pallet 110 are received in the recesses 16 of the lower pallet 10, with the walls 122 of the feet 114 of the upper pallet 110 supported on the ledge 24 of the feet 14 of the lower pallet 10, i.e. the upper surfaces of the walls 22 of the feet 114 of the lower pallet 110.

A plurality of each of the two pallets 10, 110 can be used together in a system. The narrower pallet 10 can be used for deliveries to locations where the reduced width is advantageous and/or where the products to be carried permit the reduced width. The wider pallet 110 can be used for deliveries where an increased deck width is accommodated and/or where the products to be carried require the increased width. A mixture of the two pallets 10, 110 can be stacked together when empty to return all of the pallets 10, 110 to the distribution facility to be sorted and reused.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A pallet comprising:

a deck including an upper support surface and a peripheral wall extending downward from a periphery of the upper support surface; and a plurality of feet extending downward from the deck, each of the feet including a foot wall defining a periphery of the foot, an outer portion of each foot wall coterminous with the peripheral wall of the deck, wherein the outer portion of each foot wall includes vertical corrugations, the deck including an opening aligned with each of the plurality of feet, wherein the foot wall protrudes inwardly of the respective opening to form a ledge recessed downward from the upper support surface of the deck.

2. The pallet of claim 1 wherein the outer portion of each foot wall is in a vertical plane containing the peripheral wall of the deck.

3. The pallet of claim 1 wherein each foot includes a plurality of ribs projecting inward of the foot and having an uppermost surface in a horizontal plane containing the ledge.

4. The pallet of claim 1 wherein the outer portion of each foot wall is recessed downward from the upper support surface of the deck.

5. The pallet of claim 1 wherein the deck and feet are injection molded as a single piece of plastic.

6. A first pallet and second pallet in combination comprising:

the first pallet including a deck including an upper support surface and a peripheral wall extending downward from a periphery of the upper support surface, the first pallet further including a plurality of feet extending downward from the deck, each of the feet including a foot wall defining a periphery of the foot, an outer portion of each foot wall coterminous with the peripheral wall of the deck, the deck including an opening aligned with each of the plurality of feet, wherein the foot wall protrudes inwardly of the respective opening to form a ledge recessed downward from the upper support surface of the deck; and the second pallet including a deck including an upper support surface and a peripheral wall extending downward from a periphery of the upper support surface; and a plurality of feet extending downward from the deck, each of the feet including a foot wall defining a periphery of the foot, an outer portion of each foot wall spaced inward of the peripheral wall of the deck, the deck including an opening aligned with each of the plurality of feet, wherein the foot wall protrudes inwardly of the respective opening to form a ledge recessed downward from the upper support surface of the deck.

7. The combination of the first pallet and the second pallet of claim 6 wherein the feet of the first pallet are configured to be received in the openings in the deck of the second pallet with the feet of the first pallet supported on the ledges of the second pallet.

8. The combination of the first pallet and the second pallet of claim 7 wherein the feet of the second pallet are configured to be received in the openings in the deck of the first pallet with the feet of the first pallet supported on the ledges of the second pallet.

9. The combination of the first pallet and the second pallet of claim 8 wherein the deck of the second pallet is wider than the deck of the first pallet.

10. The combination of the first pallet and the second pallet of claim 9 wherein the first pallet is stacked on the second pallet with the feet of the first pallet received in the openings in the deck of the second pallet with the feet of the first pallet supported on the ledges of the second pallet.

11. The pallet of claim 10 wherein the outer portion of each foot wall of the first pallet includes vertical corrugations.

12. The pallet of claim 1 wherein the outer portion of each foot wall is in a vertical plane containing the peripheral wall of the deck.

13. The pallet of claim 12 wherein each foot includes a plurality of ribs projecting inward of the foot and having an uppermost surface in a horizontal plane containing the ledge.

14. The pallet of claim 13 wherein the outer portion of each foot wall is recessed downward from the upper support surface of the deck.

15. The pallet of claim 14 wherein the deck and feet are injection molded as a single piece of plastic.

16. A pallet comprising:

a deck including an upper support surface and a peripheral wall extending downward from a periphery of the upper support surface; and a plurality of feet extending downward from the deck, each of the feet including a foot wall defining a periphery of the foot, an outer portion of each foot wall coterminous with the peripheral wall of the deck, the deck including an opening aligned with each of the plurality of feet, wherein the foot wall protrudes inwardly of the respective opening to form a ledge recessed downward from the upper support surface of the deck, wherein the ledges of the plurality of feet are coplanar with the deck.

17. The pallet of claim 16 wherein the ledges of the plurality of feet are coplanar with one another.

18. The pallet of claim 16 wherein the outer portion of each foot wall is in a vertical plane containing the peripheral wall of the deck.

19. The pallet of claim 16 wherein each foot includes a plurality of ribs projecting inward of the foot and having an uppermost surface coplanar with the ledges.

20. The pallet of claim 19 wherein the outer portion of each foot wall is recessed downward from the upper support surface of the deck.

21. The pallet of claim 20 wherein the deck and feet are injection molded as a single piece of plastic.

22. The pallet of claim 16 wherein the outer portion of each foot wall is recessed downward from the upper support surface of the deck and wherein the deck and feet are injection molded as a single piece of plastic.

23. A pallet comprising:

a deck including an upper support surface and a peripheral wall extending downward from a periphery of the upper support surface; and a plurality of feet extending downward from the deck, each of the feet including a foot wall defining a periphery of the foot, an outer portion of each foot wall coterminous with the peripheral wall of the deck, the deck including an opening aligned with each of the plurality of feet, wherein each foot includes a plurality of ribs projecting inward of the foot and having an uppermost surface coplanar with the deck.

24. The pallet of claim 23 wherein the outer portion of each foot wall is recessed downward from the upper support surface of the deck and wherein the deck and feet are injection molded as a single piece of plastic.

* * * * *